US010973730B2

(12) United States Patent
Fellingham et al.

(10) Patent No.: US 10,973,730 B2
(45) Date of Patent: Apr. 13, 2021

(54) WHEELED WALKER

(71) Applicant: Protostar, Inc., a Delaware Corporation, San Diego, CA (US)

(72) Inventors: Peter James Fellingham, San Diego, CA (US); Yichuan Pan, San Diego, CA (US)

(73) Assignee: Protostar, Inc., a Delaware Corporation, San Diego, CA (US)

( * ) Notice: Subject to any disclaimer, the term of this patent is extended or adjusted under 35 U.S.C. 154(b) by 0 days.

(21) Appl. No.: 16/836,763

(22) Filed: Mar. 31, 2020

(65) Prior Publication Data

US 2020/0222268 A1 Jul. 16, 2020

Related U.S. Application Data

(63) Continuation of application No. 16/150,187, filed on Oct. 2, 2018, now Pat. No. 10,617,592.
(Continued)

(51) Int. Cl.

| | |
|---|---|
| ***A61H 3/04*** | (2006.01) |
| ***A61H 1/00*** | (2006.01) |
| *A61H 3/00* | (2006.01) |

(52) U.S. Cl.
CPC ..... *A61H 3/04* (2013.01); *A61H 1/00* (2013.01); *A61H 2003/002* (2013.01);
(Continued)

(58) Field of Classification Search
CPC ..... A61H 3/04; A61H 1/00; A61H 2003/006; A61H 2003/046; A61H 2201/0192;
(Continued)

(56) References Cited

U.S. PATENT DOCUMENTS

| | | | |
|---|---|---|---|
| 2,046,105 | A | 6/1936 | Bowen |
| 3,394,933 | A | 7/1968 | Benoit |

(Continued)

FOREIGN PATENT DOCUMENTS

| | | |
|---|---|---|
| CN | 303106952 | 2/2015 |
| EP | 3095431 | 11/2016 |

(Continued)

OTHER PUBLICATIONS

Manton, et al., "Changes in the Use of Personal Assistance and Special Equipment from 1982 to 1989: Results from the 1982 and 1989 NLTCS," Gerontologist 33 (2):168-76 (Apr. 1993).

(Continued)

*Primary Examiner* — John D Walters
(74) *Attorney, Agent, or Firm* — Stetina Brunda Garred and Brucker

(57) ABSTRACT

A rollator including a frame having first and second side frames extending along respective ones of a pair of planes. First and second upper body supports are coupled to and disposable at an adjustable height above the frame. A pair of forearm gutters are coupled to respective ones of the first and second upper body supports for engaging and supporting a respective forearm of the user during use. Each forearm gutter includes a peripheral edge, a forward midpoint on the peripheral edge, and a rearward midpoint on the peripheral edge. Each forearm gutter defines a longitudinal axis bisecting the respective forearm gutter and passing through the forward midpoint and the rearward midpoint. The forward midpoint and the rearward midpoint on each forearm gutter fall between the pair of planes.

20 Claims, 17 Drawing Sheets

Related U.S. Application Data

(60) Provisional application No. 62/569,108, filed on Oct. 6, 2017.

(52) U.S. Cl.
CPC .. *A61H 2003/006* (2013.01); *A61H 2003/046* (2013.01); *A61H 2201/0157* (2013.01); *A61H 2201/0161* (2013.01); *A61H 2201/0173* (2013.01); *A61H 2201/0192* (2013.01); *A61H 2201/1253* (2013.01); *A61H 2201/164* (2013.01); *A61H 2201/1633* (2013.01); *A61H 2201/1635* (2013.01); *A61H 2201/5053* (2013.01); *A61H 2203/0406* (2013.01); *A61H 2203/0425* (2013.01); *A61H 2203/0431* (2013.01)

(58) Field of Classification Search
CPC .... A61H 2201/1253; A61H 2201/0157; A61H 2201/0161; A61H 2201/0173; A61H 2201/1633; A61H 2201/1635; A61H 2201/164; A61H 2201/5053; A61H 2203/0406; A61H 2203/0425; A61H 2203/0431
USPC ..... 280/42
See application file for complete search history.

(56) References Cited

U.S. PATENT DOCUMENTS 3,625,237 A 12/1971 Wertz
4,018,440 A 4/1977 Deutsch
4,510,956 A 8/1985 King
4,907,794 A 3/1990 Rose
5,020,560 A 6/1991 Turbeville
5,137,102 A 8/1992 Houston
5,224,562 A 7/1993 Reed
5,411,044 A 5/1995 Andolfi
5,605,169 A 2/1997 Light
5,626,094 A 5/1997 Jeffrey et al.
5,636,651 A 6/1997 Einbinder
5,657,783 A 8/1997 Sisko et al.
5,676,388 A 10/1997 Bertani
5,702,326 A * 12/1997 Renteria ..... A61H 3/04 135/67
5,741,020 A 4/1998 Harroun
5,803,103 A 9/1998 Haruyama
6,048,292 A 4/2000 Gasquez
6,099,002 A 8/2000 Uchiyama
6,494,469 B1 12/2002 Hara et al.
6,708,705 B2 3/2004 Nasco, Sr.
6,733,018 B2 5/2004 Razon
6,886,575 B2 5/2005 Diamond
6,921,101 B1 7/2005 Lauren et al.
6,974,142 B1 12/2005 Shikinami et al.
6,983,813 B1 1/2006 Wright
7,001,313 B1 2/2006 Crnkovich
7,052,030 B2 5/2006 Serhan
7,108,004 B2 9/2006 Cowie
7,111,856 B1 9/2006 Graham
7,275,554 B2 10/2007 Mulholland
D561,065 S 2/2008 Kindberg et al.
7,377,285 B2 5/2008 Karasin et al.
7,422,025 B1 9/2008 Waldstreicher et al.
7,494,138 B2 2/2009 Graham
7,497,449 B2 3/2009 Logger
7,500,680 B2 3/2009 Dayton et al.
7,540,342 B1 6/2009 Ein
7,559,560 B2 7/2009 Li et al.
7,568,712 B2 * 8/2009 Kovachi ..... A61H 3/008 280/23.1
7,669,863 B2 5/2010 Steiner et al.
7,708,120 B2 5/2010 Einbinder
7,866,677 B1 1/2011 Rothstein et al.
7,992,584 B1 8/2011 Birnbaum
8,002,295 B1 8/2011 Clark
8,100,415 B2 1/2012 Kindberg et al.
D654,833 S 2/2012 Pettersson et al.
8,151,812 B2 4/2012 Razon
8,166,987 B2 5/2012 Weaver
8,215,652 B2 7/2012 Dashew et al.
8,234,009 B2 7/2012 Kitahama
8,251,079 B1 8/2012 Lutz et al.
8,468,622 B2 6/2013 Purwar et al.
8,540,256 B1 9/2013 Simpson
8,562,007 B2 10/2013 Menichini
8,573,612 B1 11/2013 Fulk et al.
8,678,425 B2 3/2014 Schaaper et al.
8,740,242 B2 6/2014 Slomp
8,770,212 B2 7/2014 Alghazi
8,783,700 B2 7/2014 Li
8,794,252 B2 8/2014 Alghazi
8,840,124 B2 9/2014 Serhan et al.
8,936,033 B2 1/2015 Velarde
8,983,732 B2 3/2015 Lisseman et al.
8,998,223 B2 4/2015 Chang
9,016,297 B2 4/2015 Salomon
D739,314 S 9/2015 Wang et al.
9,149,408 B2 10/2015 Karlovich
9,173,802 B2 11/2015 Willis
9,180,066 B2 11/2015 Izard et al.
9,186,992 B2 11/2015 Katayama
9,221,433 B2 12/2015 Dunlap
9,226,868 B2 1/2016 Andersen
9,289,347 B2 3/2016 Powell
D754,034 S 4/2016 Wang et al.
D754,568 S 4/2016 Wang et al.
9,314,395 B1 4/2016 Vanausdall
9,339,432 B2 5/2016 Liu et al.
9,351,898 B2 * 5/2016 Triolo ..... A61H 3/00
9,375,097 B2 6/2016 Stango
9,381,132 B2 7/2016 Chen
9,486,385 B1 11/2016 Terrill
9,566,207 B1 2/2017 Ratliff
9,585,807 B2 3/2017 Fellingham et al.
9,646,514 B2 5/2017 Rizzo
9,662,264 B2 5/2017 Jacobs
9,687,411 B2 6/2017 Chen
9,744,094 B2 8/2017 Liu et al.
9,763,849 B2 9/2017 Paterson et al.
9,795,825 B2 10/2017 Johnson
9,839,571 B2 12/2017 Pan
D807,793 S 1/2018 Paterson et al.
9,877,889 B2 1/2018 Chen
9,907,723 B2 3/2018 Bisceglia et al.
9,968,509 B2 5/2018 Andersen
9,974,708 B1 5/2018 Janeczek et al.
D819,503 S 6/2018 Huang
D836,499 S 12/2018 Delatorre et al.
D837,697 S 1/2019 Luo
D845,841 S 4/2019 No-Young
10,307,321 B2 6/2019 Pan et al.
D865,575 S 11/2019 Lin
10,543,144 B2 1/2020 Johnson et al.
10,555,866 B2 2/2020 Pan et al.
2001/0048206 A1 12/2001 Niu et al.
2003/0137119 A1 7/2003 Razon
2005/0156395 A1 7/2005 Bohn
2005/0211285 A1 9/2005 Cowie et al.
2007/0170699 A1 7/2007 Li et al.
2007/0204429 A1 * 9/2007 Cheng ..... B60B 33/0057 16/35 R
2008/0079230 A1 4/2008 Graham
2009/0224499 A1 9/2009 Dashew et al.
2012/0256384 A1 10/2012 Schaaper et al.
2012/0318311 A1 12/2012 Alghazi
2013/0082454 A1 4/2013 Slomp
2013/0319488 A1 12/2013 Chiu
2014/0116482 A1 5/2014 Simpson
2014/0125037 A1 5/2014 Andersen
2014/0265256 A1 9/2014 Rothstein et al.
2014/0333040 A1 11/2014 Liu
2015/0051519 A1 2/2015 Morbi et al.

(56) References Cited

U.S. PATENT DOCUMENTS

| | | | | |
|---|---|---|---|---|
| 2015/0066242 | A1 | 3/2015 | Tanaka | |
| 2015/0066325 | A1 | 3/2015 | Tanaka | |
| 2015/0066328 | A1 | 3/2015 | Nakada | |
| 2015/0173994 | A1 | 6/2015 | Chen | |
| 2015/0216757 | A1 | 8/2015 | Powell et al. | |
| 2015/0306440 | A1 | 10/2015 | Bucher et al. | |
| 2015/0320633 | A1 | 11/2015 | Jacobs | |
| 2015/0335940 | A1 | 11/2015 | Johnson | |
| 2016/0035228 | A1 | 2/2016 | Cakmak | |
| 2016/0074262 | A1 | 3/2016 | Moses et al. | |
| 2016/0120731 | A1 | 5/2016 | Vanausdall | |
| 2016/0151230 | A1 | 6/2016 | Bagheri | |
| 2016/0253890 | A1 | 9/2016 | Rabinowitz et al. | |
| 2016/0287465 | A1 | 10/2016 | Rabin et al. | |
| 2016/0296409 | A1 | 10/2016 | Schraudolph et al. | |
| 2016/0331610 | A1* | 11/2016 | Brown | A61G 5/0833 |
| 2016/0331626 | A1* | 11/2016 | Fellingham | A61H 3/04 |
| 2017/0008544 | A1 | 1/2017 | Kindberg | |
| 2017/0112706 | A1 | 4/2017 | Bruk et al. | |
| 2017/0065479 | A1 | 5/2017 | Fellingham et al. | |
| 2017/0175997 | A1 | 6/2017 | Rosenblum | |
| 2017/0209319 | A1 | 7/2017 | Fawcett | |
| 2017/0231857 | A1 | 8/2017 | Vanausdall | |
| 2017/0239130 | A1 | 8/2017 | Rizzo | |
| 2017/0258664 | A1 | 9/2017 | Purcell | |
| 2018/0250189 | A1 | 9/2018 | Johnson | |
| 2018/0360686 | A1 | 12/2018 | Fellingham et al. | |
| 2019/0105220 | A1 | 4/2019 | Pan et al. | |
| 2019/0105221 | A1 | 4/2019 | Pan et al. | |
| 2019/0105222 | A1 | 4/2019 | Fellingham et al. | |
| 2019/0209418 | A1 | 7/2019 | Vanausdall | |
| 2019/0231632 | A1 | 8/2019 | Hoekelmann et al. | |
| 2019/0254918 | A1 | 8/2019 | Fellingham et al. | |

FOREIGN PATENT DOCUMENTS

| | | |
|---|---|---|
| GB | 1342397 | 1/1974 |
| JP | 2012019831 A | 2/2012 |
| WO | 98/45167 | 10/1998 |

OTHER PUBLICATIONS

Laplante, et al., "Demographics and Trends in Wheeled Mobility Equipment Use and Accessibility in the Community," Assistive Technology, 22, 3-17, (2010).

Martins et al., Assistive Mobility Devices focusing on Smart Walkers: Classification and Review, Robotics and Autonomous Systems 60 (4), Apr. 2012, pp. 548-562.

Copenheaver, Blaine R., International Search Report and Written Opinion; PCT/US2018/054709; dated Feb. 1, 2019; 17 pages.

Nasson et al., "Effective Shared Control in Cooperative Mobility Aids," Proc. 14th Int. Florida Artificial Intelligence Research Society Conf, May 2001, pp. 5509-518.

Neto et al., "Extraction of user's navigation commands from upper body force interaction in walker assisted gait," BioMedical Engineering OnLine 2010, 9:37.

Frizera et al., "The Smart Walkers as Geriatric Assistive Device. The SIMBIOSIS Purpose," SIMBIOSIS Project—Spanish National Program of R&D—DPI, Jan. 2008.

Einbinder et al., "Smart Walker: A tool for promoting mobility in elderly adults," JPRD, vol. 47, No. 9, 2010.

Frisoli et al., "Technical Area Overview for the IEEE Technical Committee on Haptics," IEEE TCH, Dec. 2012.

Schmidt, "HapticWalker—A novel haptic device for walking simulation," Proceedings of EuroHaptics 2004, Munich, Germany, Jun. 5-7, 2004.

Morris et al, "A Robotic Walker That Provides Guidance," the Proceedings of IEEE International Conference on Robotics and Automation (ICRA '03), pp. 25-30, vol. 1.

Kulyukin et al., "iWalker: Toward a Rollator-Mounted Wayfinding System for the Elderly," 2008 IEEE International Conference on RFID, The Venetian, Las Vegas, Nevada, USA, Apr. 16-17, 2008, pp. 303-11.

Non-Final Office Action in U.S. Appl. No. 15/874,880 dated Jul. 27, 2018.

Wang, Xin, "International Preliminary Report on Patentability," PCT/US2018/054709, dated Oct. 6, 2017, 11 pages, International Bureau of WIPO, Geneva, Switzerland.

* cited by examiner

WHEELED WALKER

CROSS-REFERENCE TO RELATED APPLICATIONS

This application is a continuation of prior U.S. application Ser. No. 16/150,187, filed Oct. 2, 2018, which claims the benefit of U.S. Provisional Application No. 62/569,108, filed on Oct. 6, 2017, the contents of all the aforementioned applications being expressly incorporated herein in their entirety by reference.

This application is related by common inventorship and subject matter to the commonly assigned U.S. patent application Ser. No. 15/871,609 filed on Jan. 15, 2018, and the commonly assigned U.S. patent application Ser. No. 15/874,880 filed on Jan. 19, 2018, and the commonly assigned U.S. patent application Ser. No. 15/876,112 filed on Jan. 20, 2018, which are entirely incorporated herein by reference.

BACKGROUND

1. Field of the Disclosure

This disclosure relates generally to assistive mobility devices and more particularly to a collapsible wheeled weight bearing walker or rollator.

2. Description of the Related Art

Assistive mobility devices, including walkers or rollators, are well known in the art as useful means for reducing the disadvantages of mobility impairment suffered for many different reasons by many people, permitting more efficient ambulation over distance and thereby increased independence and improved life quality. Data from the National Long Term Care Survey suggests that increased use of assistive technology may have helped reduce disability at older ages [Manton, et al., "Changes in the Use of Personal Assistance and Special Equipment from 1982 to 1989: Results from the 1982 and 1989 NLTCS," Gerontologist 33(2):168-76 (April 1993)]. As life expectancy increases over the decades the mobility-impaired population increases much faster than the general population [LaPlante et al., "Demographics and Trends in Wheeled Mobility Equipment Use and Accessibility in the Community," *Assistive Technology,* 22, 3-17, (2010)]. Accordingly, there has long been a growing demand for improved mobility assistance devices adaptable for improving ambulation for mobility-limited persons.

Martins et al. [Martins et al., Assistive Mobility Devices focusing on Smart Walkers: Classification and Review, *Robotics and Autonomous Systems* 60 (4), April 2012, pp. 548-562] classifies mobility assistance devices into the alternative devices intended for those with total loss of independent mobility (wheelchairs or autonomous powered vehicles) and assistive or augmentative devices for those with residual mobility capacity (prostheses, crutches, canes and walkers). For several reasons, most impaired individuals prefer to avoid the alternative devices associated with total incapacity. Similarly, the rehabilitation profession strongly prefers the assistive devices, which may be used for physical therapy and as mobility-training devices. Accordingly, there has long been a growing demand for improved assistive devices adapted for use by the less disabled who otherwise cannot move independently with existing assistive devices and are forced to rely on alternative devices such as wheelchairs and powered scooters.

As one type of assistive device, many wheeled walkers or rollators have been developed and are available on the market for the benefit of mobility impaired individual. U.S. Pat. No. 7,108,004 issued to Cowie et al. discloses a typical rollator that has a right side frame and a left side frame supported by front wheels and rear wheels, a seat extended between the two side frames for the rollator user to sit on, and two handles extended from the upper structures of the side frames for grasping by the user. The rollator, including the seat, is foldable from side-to-side. However, such an assistive device has many well-known disadvantages. One notable disadvantage is that the user needs to extend her of his hands downward to grasp the handles to support her or his body weight, so relatively significant hand and arm strength is needed to operate and maneuver the device. Over the time in this type of walker, a user may develop a stooping or a forward leaning posture to avoid a hobbled gait. A stooping posture stresses the user's back and arms, compresses internal organs including heart and lung, and restrains circulations. Moreover, such posture may increase the risk of tipping forward when encountering terrain obstacles. A seat in a walker, as shown in U.S. Pat. No. 7,108,004, has the benefit of allowing the user to sit down for resting. But the disclosed seat constructed between the right and left side frames blocks the space available inside the walker footprint. Consequently, the user is forced to step behind the walker footprint to avoid kicking into the seat. This also encourages a stooping posture.

There has long been a clearly-felt need in the art for improved assistive devices to better help those who suffer from mobility impairment. The commonly-assigned U.S. Pat. No. 9,585,807 issued to Fellingham et al. discloses an upright wheeled walker with armrests that support sufficient user upper-body weight to facilitate a natural upright gait. The wheeled walker has two side frames that may be collapsed and folded and two side upper supports that may be lowered, to reduce the walker width and height for storage and transportation. A large polygonal space is created inside the walker device to prevent the user from kicking into the walker structure. With improved walking posture, the user can walk longer and get more physical exercises, thereby promoting circulation and overall health, and therapeutic effects for certain diseases, or after surgery or injury. The wheeled walker apparatus disclosed in U.S. Pat. No. 9,585,807 has improved lateral and longitudinal stability and therefore better safety for the user. This is accomplished by improving frame and connection sturdiness. The result is reduced wobbling of the upper support structure.

However, the wheeled walker of U.S. Pat. No. 9,585,807 does not include a seat. After walking for a distance when the user feels tired and wants to sit down to take a rest, the device does not provide such a seat. U.S. Pat. No. 9,744,094 issued to Liu et al. discloses a walker apparatus having a seat connected to the upright side frames. This seat is similar to the one disclosed in U.S. Pat. No. 7,108,004 discussed above, and is of a typical type provided in walkers known to practitioners. Disadvantageously, when the space inside the walker footprint is occupied by such a seat, the user is obliged to step behind the walker footprint and to lean over to reach the walker handles, thus an unhealthy walking posture.

This walker footprint problem is resolved by the collapsible combination chair/walker disclosed in U.S. Pat. No. 5,741,020 issued to Harroun. The combination chair/walker includes a removable seat that is detachably mounted on intermediate level side rails. Removing the seat leaves ample space inside the walker footprint for walking and standing. Disadvantageously, such a seat is not permanently attached to the walker and the necessary mounting and unmounting process is complicated and tedious. Moreover, the seat member may get lost during use, storage and transportation. U.S. Pat. No. 9,662,264 issued to Jacobs discloses a front entry upright walker that includes a seat that is connected with the frame to pivot between a deployed horizontal position where a user may sit upon and a stowed vertical position to allow a user to walk within the space. However, the disclosed walker structure has a weak connection between the left to right side frames that cannot provide a sturdy and stable walker frame during walking when the seat is flipped up at its stowed position.

Other improvements have been proposed for wheeled walkers. For example, it has been proposed to provide a combination assistive-alternative device for impaired users who have limited capability to operate a walker independently. Such a user may benefit from a walker for exercise or physical therapy, but must be transported in a transport chair or wheelchair by a helper after walking for awhile. U.S. Pat. No. 5,137,102 issued to Houston discloses a powered wheelchair that provides a movable seat to make space and allow the user to stand up inside the device footprint. Since this device does not allow the user to walk or stand up on the ground, its therapeutic effect is limited. And, the electrical components and complicated mechanisms of the device make it un-foldable, heavy and not easy to transport in a car, and costly to purchase. U.S. Application Pub. No. US 20170209319 by Fawcett et al. discloses an elevating chair walker that has a seat elevated by a parallelogram power unit to lower and higher positions and is convertible between a wider seat to sit and a narrower saddle to ride. The device allows the user to stroll, stride and coast, and relatively easily sit down and rise up, all in a functionally equipoised and weightless condition. Nevertheless, the walker chair surrounds the user from behind, so the user essentially pulls the device along when using it. Accordingly, such a device may be a good choice for one with limited mobility to use in or around the residence, for example, to walk or ride inside a house and to do chores and activities. But it does not provide benefits for outdoor use because one with limited mobility and balance needs the walker frame and support in front to lean on and provide a sense of security.

Other improvements have been proposed for individuals who are impaired or paralyzed on one side of the body because of health conditions such as stroke or neurological disorder. Such a user cannot control the walking direction of a wheeled walker. Thus, it would be advantageous to improve the walker device to be configured so that all wheels move in straight line.

Ease of use improvements have also been proposed. For example, walker or rollator devices usually have height adjustment mechanisms to fit individuals of different height. When a user gets a walker, however, he or she will try the walker including setting a preferred height for him or her to use. Since the user's height changes little over time, theoretically the height adjustment should be done only once. However, there will be needs time and again to collapse the walker device to its minimal size, including the smallest height, for storage and transportation purpose. This means that the device will need to be opened up for use, and height setting will need to be repeated time after time. It would be advantageous, therefore, if the preferred height, after being set, can be kept or memorized by a specially designed device.

These unresolved problems and deficiencies are clearly felt in the art and are solved by the inventive subject matter of this disclosure in the manner described below.

SUMMARY

According to one aspect of this disclosure, there is provided a rollator for use on a walking surface for a user having one or two forearms. The rollator includes a frame having a first side frame and a second side frame extending along respective ones of a spaced, generally parallel pair of planes. The first side frame and the second side frame each include at least one curved tube. A plurality of wheel assemblies are coupled to the frame for supporting the frame above the walking surface. A first upper body support is coupled to and disposable at an adjustable height above the first side frame. A second upper body support is coupled to and disposable at an adjustable height above the second side frame. A pair of forearm gutters are coupled to respective ones of the first and second upper body supports for engaging and supporting a respective forearm of the user during use. Each forearm gutter includes a peripheral edge, a forward midpoint on the peripheral edge, and a rearward midpoint on the peripheral edge. Each forearm gutter defines a longitudinal axis bisecting the respective forearm gutter and passing through the forward midpoint and the rearward midpoint. The forward midpoint and the rearward midpoint on each forearm gutter reside between each of the pair of planes.

The forward midpoint and the rearward midpoint on each forearm gutter may be spaced from each of the pair of planes.

The pair of planes may extend through respective ones of the first side frame and the second side frame. The pair of planes may extend through a respective pair of the plurality of wheel assemblies.

Each forearm gutter may define a transverse axis perpendicular to the longitudinal axis of the respective forearm gutter and bisecting the respective forearm gutter. Each forearm gutter may have a centerpoint at the intersection of the transverse axis and the longitudinal axis. A first distance may be defined between the centerpoints of the pair of forearm gutters, and a second distance may be defined between the two opposing side planes. The first distance may be less than the second distance.

The first side frame and the second side frame may include a curved front tube and a curved rear tube.

The rollator may additionally include a seat member translatably coupled to the frame.

The rollator may further comprise a plurality of wheel direction locks each coupled to the frame above a respective wheel assembly. Each wheel direction lock may include a wheel direction lock element adapted to insert into a lock depression in a respective wheel fork to lock the respective wheel fork relative to the frame.

According to another aspect of the disclosure, there may be provided a rollator for use on a walking surface for a user having one or two forearms. The rollator includes a frame having a first side frame and a second side frame extending along respective ones of a spaced, generally parallel pair of planes. A plurality of wheel assemblies are coupled to the frame for supporting the frame above the walking surface. A first upper body support is coupled to and disposable at an adjustable height above the first side frame. A second upper body support is coupled to and disposable at an adjustable height above the second side frame. A pair of forearm gutters are coupled to respective ones of the first and second upper body supports for engaging and supporting a respective forearm of the user during use. Each forearm gutter defines a longitudinal axis bisecting the respective forearm gutter, with at least a majority of the longitudinal axis that extends along the corresponding forearm gutter residing between each of the pair of planes.

The entirety of the longitudinal axis extending along the corresponding forearm gutter may reside between the pair of planes.

The rollator may further comprise an X-folder apparatus including an anterior element having two ends and a posterior element having two ends. The anterior element may be rotatably coupled to the posterior element. A first end of the anterior element may be rotatably coupled to the first side frame, and a first end of the posterior element may be rotatably coupled to the second side frame, such that rotation of the anterior element and the posterior element may be adapted to move the X-folder between an open X-folder state and a closed X-folder state. The first end of the anterior element may be rotatably coupled to a lower portion of the first side frame at two locations disposed at a first horizontal distance, and the first end of the posterior element of the X-folder may be rotatably coupled to a lower portion of the second side frame at two locations disposed at a second horizontal distance, such that the first horizontal distance and the second horizontal distance may be selected to dispose the first side frame into substantial parallel disposition with the second side frame.

According to a further aspect of the disclosure, there is provided a rollator for use on a walking surface for a user having one or two forearms. The rollator includes a frame having a first side frame and a second side frame extending along respective ones of a spaced, generally parallel pair of planes. A plurality of wheel assemblies are coupled to the frame for supporting the frame above the walking surface. A first upper body support is coupled to and is disposable at an adjustable height above the first side frame. A second upper body support is coupled to and is disposable at an adjustable height above the second side frame. A pair of forearm gutters are coupled to respective ones of the first and second upper body supports for engaging and supporting a respective forearm of the user during use, with a majority of each forearm gutter being positioned between the pair of planes.

The foregoing, together with other objects, features and advantages of the subject matter of this disclosure, can be better appreciated with reference to the following specification, claims and the accompanying drawing.

BRIEF DESCRIPTION OF THE DRAWINGS

For a more complete understanding of this disclosure, reference is now made to the following detailed description of the embodiments as illustrated in the accompanying drawing, in which like reference designations represent like features throughout the several views and wherein.

DETAILED DESCRIPTION

Figure 1:
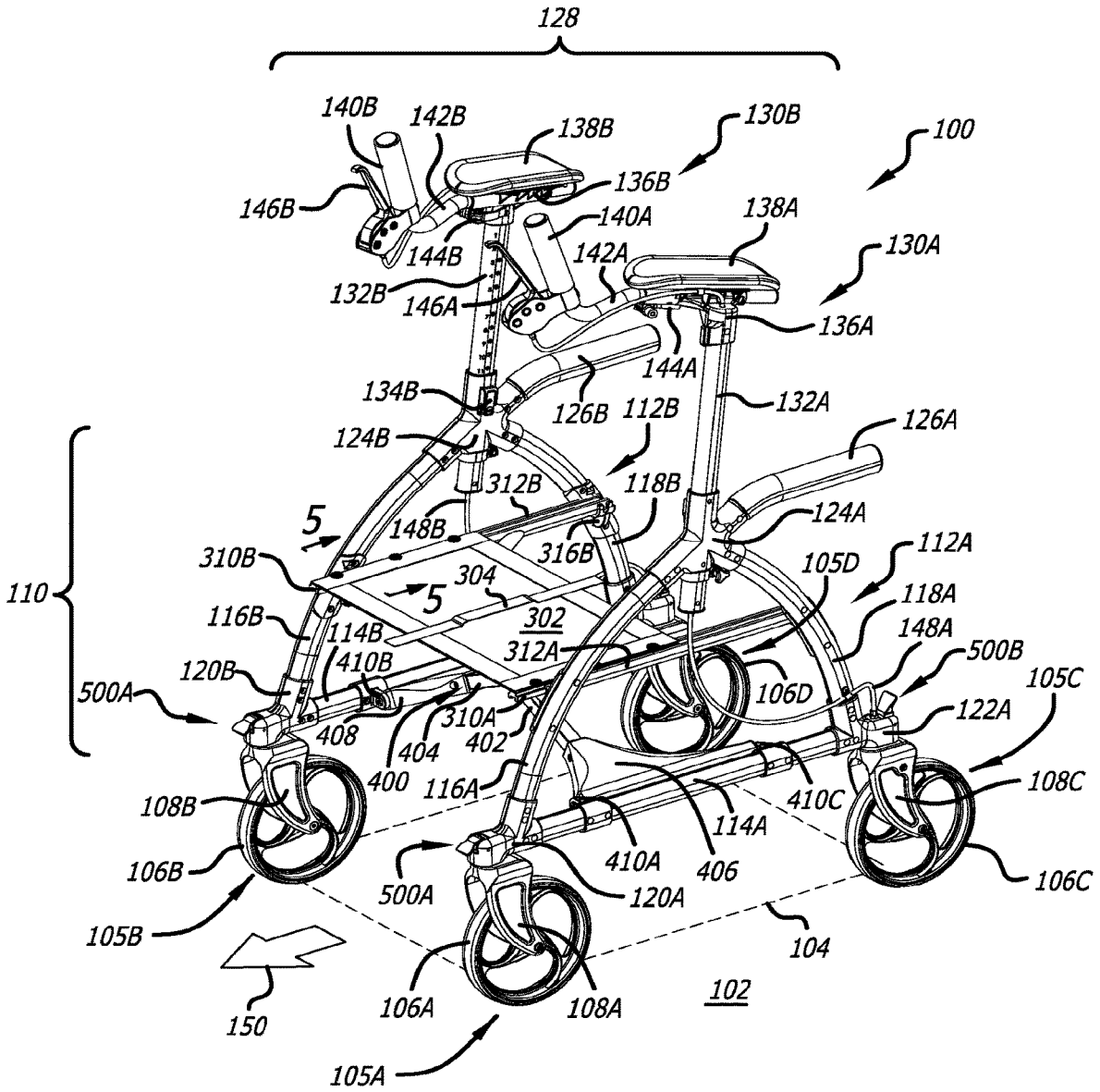
FIG. 1 is a perspective view of a wheeled walker having two side frames supported by four wheel assemblies, two upper body supports, and an X-folder to support the side frames and to enable side-to-side collapsing, wherein the walker has a seat disposed between the two side frames and may slide in the forward and backward direction.

FIG. 1 shows an embodiment of a wheeled walker (or rollator) apparatus 100 in the open state on a walking surface 102 ready to receive a user 700 (FIG. 16) to operate and move along moving direction 150. Wheeled walker apparatus 100 has a frame 110 supported on walking surface 102 by four wheel assemblies 105A-D. Frame 110 includes a left side frame 112A and a right side frame 112B, each having three side frame tubes, including a respective frame horizontal tube 114A-B, a respective frame front tube 116A-B, and a respective frame rear tube 118A-B. The three side frame tubes of each side frame 112A-B form an approximately triangular shaped frame, and are connected by three respective joints, including a frame front joint 120A-B, a frame rear joint 122A-B, and a fame top joint 124A-B. For better stability, the front tubes 116A-B and rear tubes 118A-B are curved outward. On the rear end of each side frame 112A-B is attached a lower handle 126A-B.

As constructed, frame 110 forms a polygonal footprint 104 on walking surface 102. Wheel assemblies 105A-D each includes a respective wheel 106A-D and a respective wheel fork 108A-D, that is coupled to frame 110 at a vertex that is a corresponding front or rear frame joint. Each frame joint above the respective wheel assembly is coupled with a wheel direction lock 500A-B to control wheel movement direction. More details of wheel direction lock 500A-B will be depicted in connection with FIGS. 8-10 in a subsequent section.

Wheeled walker 100 further includes an upper body support 128 having a left side upper body support 130A and a right side upper body support 130B. Each upper body support 130A-B includes a respective forearm gutter 138A-B attached to an upper support joint 136A-B to support a forearm 710A-B of user 700 (FIG. 16), and a respective upper handle 140A-B for a user hand 720A-B (FIG. 16) to grasp during use. Each upper handle 140A-B is supported by a respective upper handle support tube 142A-B that is rotatably engaged with respective upper support joint 136A-B. In this way, each upper handle 140A-B is able to turn with the support tube with respect to upper support joint 136A-B, and the angular orientation of the upper handle may be locked in place by a respective upper handle cam lever 144A-B that is connected with upper support joint 136A-B. Preferably, each upper handle support tube 142A-B has a spring plunger to engage with one or a plurality of holes in the respective upper support joint 136A-B to accurately position the angular orientations of the upper handle.

On each upper handle support tube 142A-B just below respective upper handle 140A-B is further attached a respective brake lever 146A-B, that is connected to a respective brake 580 (FIG. 9) through a respective brake cord 148A-B. Brake levers 146A-B, as exemplified by brake lever 146A, are now discussed. When brake lever 146A is squeezed or pulled backward by a user hand, the action sends a force to respective brake 580 through brake cord 148A to stop the wheel from moving. When the pulling force is released, brake lever 146A recovers to its neutral position automatically as urged by a brake spring 582 (FIG. 9), and the braking effect is thus relaxed. Another user action is to push brake lever 146A forward so that the brake lever stops and stays at a parking position. This parking function is realized because of a cam-like structure connected to the brake lever. When the brake lever stops at the parking position, rear wheel 106A is braked until brake lever 146A is pulled back by the user to be out of the parking position.

Each upper support joint 136A-B is connected to a respective height adjustment tube 132A-B, in addition to respective forearm gutter 138A-B and respective upper handle support tube 142A-B. Each height adjustment tube 132A-B is threaded through a hole inside respective frame top joint 124A-B, and is preferably tilted rearward for about 0-15 degrees off from the vertical axis that is perpendicular to walking surface 102. The height of each side upper body support 130A-B is therefore adjustable by moving the respective height adjustment tube 132A-B up and down relative to respective frame top joint 124A-B, and may be locked in place by a height adjustment tab 134A-B. More details of upper body support height adjustment are described below in connection with FIGS. 13-14.

Figure 2:
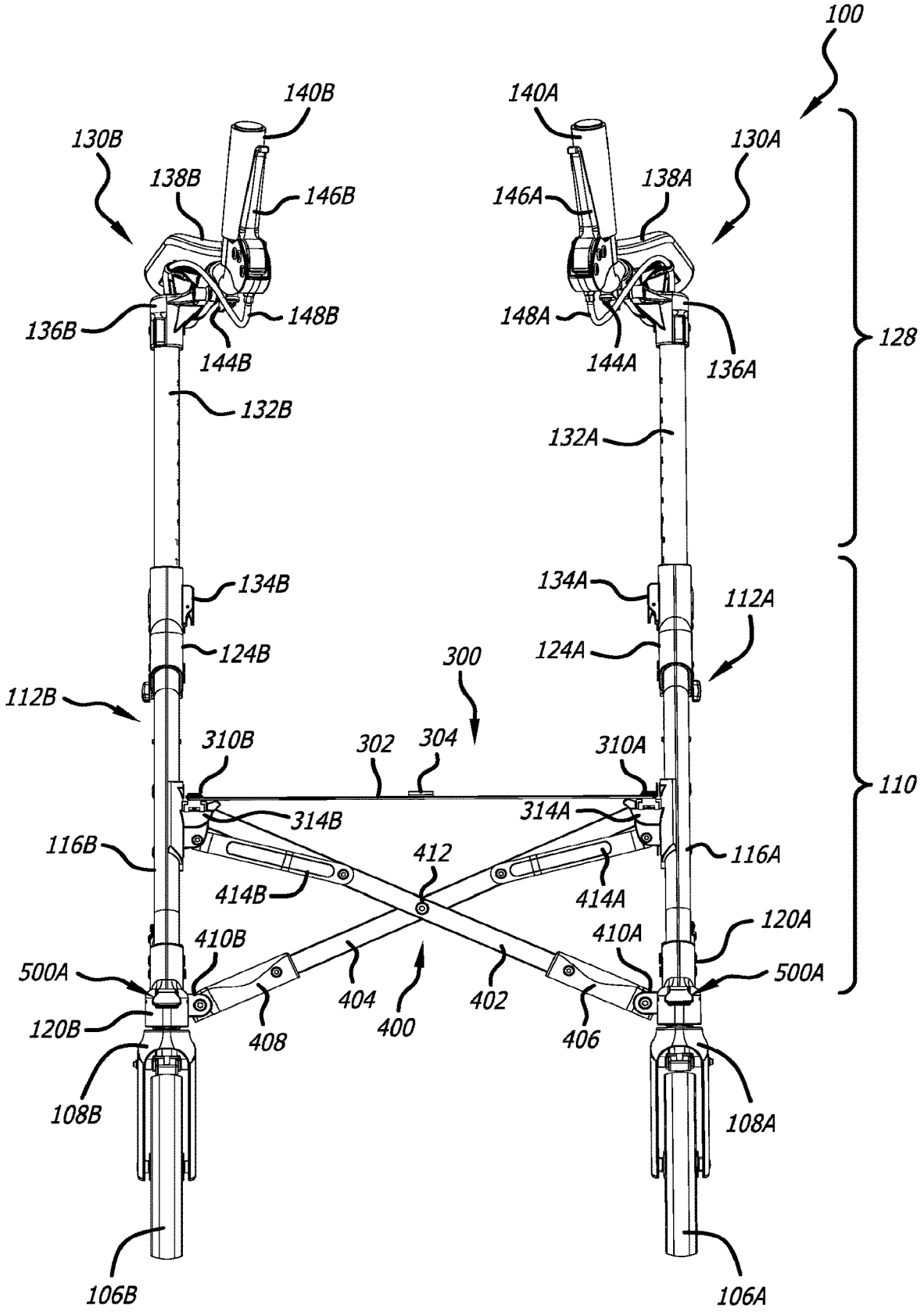
FIG. 2 is a front view of the wheeled walker of FIG. 1.
Figure 3:
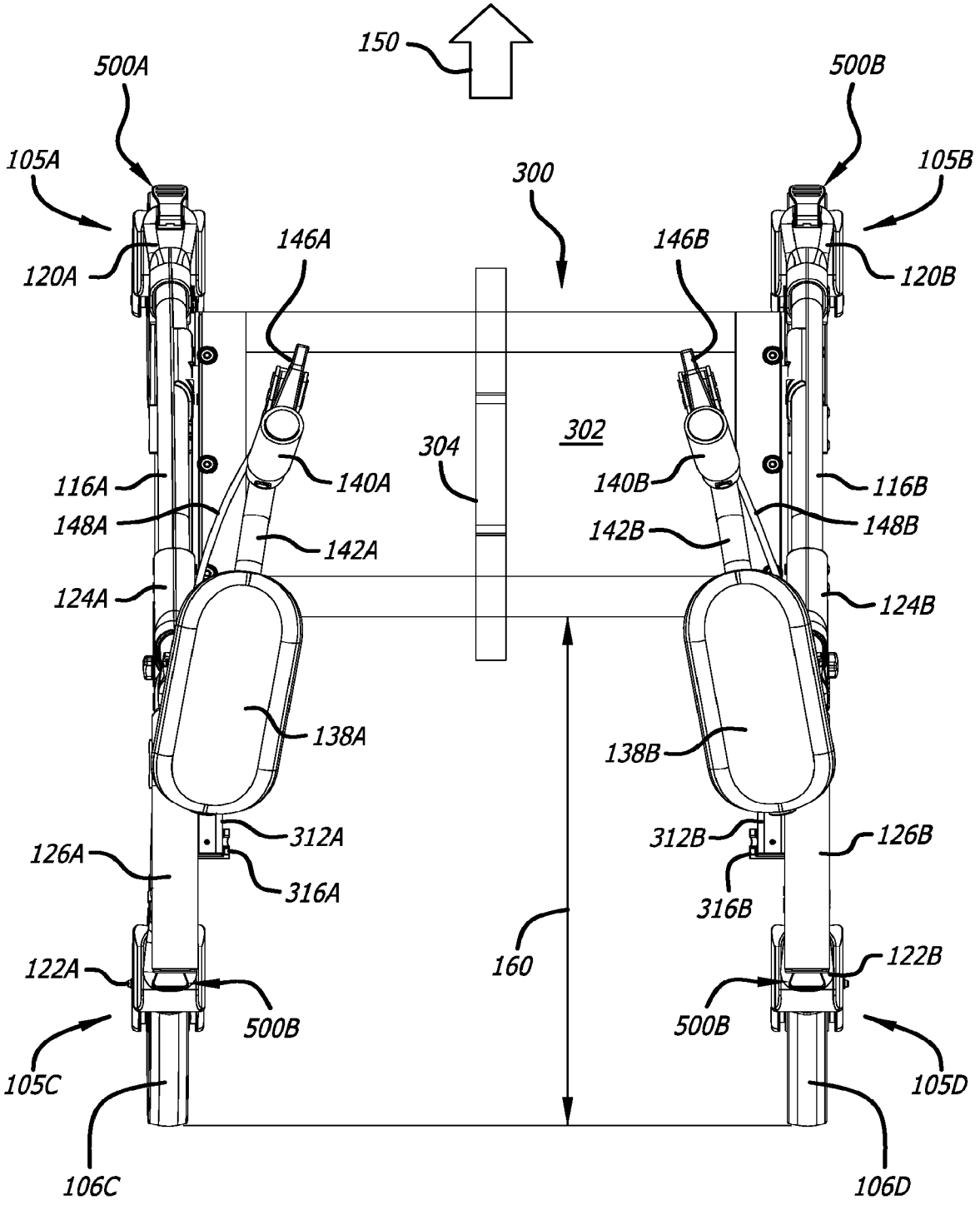
FIG. 3 is a top view of the wheeled walker of FIG. 1.

Referring to FIG. 2, a front view of wheeled walker 100 of FIG. 1, and FIG. 3, a top view of wheeled walker 100 of FIG. 1, the same walker embodiment is presented from different angles to reveal details that are not clearly shown in FIG. 1. Specifically, more details of an X-folder system 400 and a seat system 300 are shown. Combining the views of FIGS. 1-3 one can see that X-folder system 400 includes an anterior bar 402 that is rotatably connected to a posterior bar 404 by a center hinge 412. Anterior bar 402 is affixed at the lower end to an anterior delta plate 406 that is rotatably connected to frame horizontal tube 114A of side frame 112A by lower hinges 410A and 410C. And posterior bar 404 is affixed at the lower end to a posterior delta plate 408 that is rotatably connected to frame horizontal tube 114B of side frame 112B by lower hinges 410B and 410D. At the upper end, anterior bar 402 is affixed to a seat rail 312B, that is coupled to the right edge of a seat member 302, and posterior bar 404 is affixed to a seat rail 312A, that is coupled to the left edge of seat member 302.

From the structure of X-folder 400 shown in FIGS. 1-3, one of ordinary skill in the art will appreciate that when wheels 106A-D are placed on walking surface 102 that is substantially horizontal, rotational movement of anterior bar 402 and posterior bar 404 relative to each other around center hinge 412 is constrained by the wheels through the left and right side frames. As such, this movement causes anterior bar 402 and posterior bar 404 to move between a near vertical end-position and a near horizontal end-position determined by the physical limitations of the X-folder structure. When an action causes anterior bar 402 and posterior bar 404 to move and turn about each other toward the near vertical end-position, anterior bar 402 and posterior bar 404 pull the lower portions of side frames 112A-B together through lower hinges 410A-D. At the same time, the vertical movement of X-folder 400 causes seat rails 312A-B to move out of seat rail holders 314A-B and 316A-B and then move upward to bring the seat therewith. And the upper portions of side frames 112A-B are brought along by linkage bars 414A-B. Consequently, wheeled walker 100 is collapsed in width and becomes folded. When anterior bar 402 and posterior bar 404 are rotated about each other toward the near horizontal end-position, the action pushes the side frames 112A-B apart. When seat rails 312A-B is each aligned with and pushed into respective seat rail holders 314A-B and 316A-B to force wheeled walker 100 into a stable open state. It is a feature of the subject matter of this disclosure that seat rail 312A-B is held tightly in seat rail holders 314A-B and 316A-B for walker stability. And yet the rail to holder engagement is loose enough to allow the rail to pop out of the holders when folding is initiated.

Also from viewing FIGS. 1-3, seat system 300 includes seat member 302 having a seat handle 304 thereon. Seat member 302 has a left side edge and a right side edge each attached to a respective seat slider 310A-B that is connected and slides on respective seat rail 312A-B. Through the sliding action, seat system 300 may translate between a front end or anterior position (FIGS. 1-3) for walking and a rear end or posterior position (FIG. 12) for sitting.

It is an advantage of the apparatus of this disclosure that walker stability and user safety during use are optimized. Stability and safety are important because many impaired users are in poor health conditions with limited balancing capability. The triangular shape of delta plates 406 or 408 of X-folder 400 at each side ensures a relatively large horizontal span in the front to back direction of walker 100 between lower hinges 410A and 410C or lower hinges 410B and 410D to connect to respective side horizontal tube 114A-B. This relatively large span between lower hinges 410A and 410C or between lower hinges 410B and 410D may also be achieved through other means. For example, anterior bar 402 may be affixed to a rigid bar that is connected to hinges 410A and 410C, and posterior bar 404 may be affixed to another rigid bar that is connected to hinges 410B and 410D. Preferably, the distance between lower hinges 410A and 410C and the distance between lower hinges 410B and 410D are both greater than 10 inches. Each pair of outward curved frame front tube 116A-B and frame rear tube 118A-B ensures that respective seat rail 312A-B is relatively long, and thus a relatively large upper span between respective seat rail holders 314A-B and 316A-B. Preferably, the distance between the rail holders 314A-B and 316A-B at each side is greater than 10 inches. And it is further preferred that this span distance is greater than 15 inches.

Coupled with properly constructed anterior bar 402 and posterior bar 404, the large lower spans and the large upper spans as defined above ensure the whole frame is rigid and especially that left frame 112A and right frame 112B are kept substantially parallel to each other even under force during use. When wheeled walker 100 is at its open state, the large lower spans on the left side and right side keep the lower portion of left side frame 112A and the lower portion of right side frame 112B at the same distance from front to back. And the large upper spans on the left side and right side do the same thing for the upper portions of the two side frames. Further, the large lower spans and upper spans together with a stiff X-folder 400 keep the plane of left side frame 112A and the plane of right side frame 112B not rotating with each other. Thus the whole frame 110 is rigid and stable during use, especially when walking surface 102 is bumpy. Anterior bar 402 and posterior bar 404 are constructed in such a way to achieve required stiffness in order to stand with bending and distortion. It is preferred that material elastic modulus, cross-sectional shape, reinforcement, location and size of holes on the bars be selected to facilitate the purposes and features of the apparatus of this disclosure. For cross-sectional shape consideration for anterior bar 402 and posterior bar 404, for example, a tube is in general better than a solid bar, and a square tube is in general better than a round tube.

The distance between front wheels 106A-B and rear wheels 106C-D and the positioning of forearm gutters 138A-B are preferably selected to facilitate the purposes and features of the apparatus of this disclosure. For example, during walking when front wheels 106A-B hit a rough terrain on walker surface 102, such as an obstacle or a rock, the horizontal distance between front wheels 106A-B and forearm gutters 138A-B is preferably selected to keep walker 100 from tipping forward. The longer this distance, the safer it is for forward tipping over. Further, the distance between front wheels 106A-B and rear wheels 106C-D is preferably selected to be long enough to allow the user to walk between the left and right frames and inside the walker. In this way, backward tipping can be effectively prevented. A sufficient front-to-rear wheel distance also helps create an adequate span 160, as shown in FIG. 3, inside the walker from the outbound line formed by rear wheels 106C-D to the rear edge of seat member 302 at its anterior walking position. Such an adequate span allows the user to walk in walker 100 without hitting his or her knees or shins to seat 302 or other walker parts. With the help of forearm gutters above and ample span below, he or she may straight up his or her upper body, keep an upright gait that is beneficial to health and promoting dignity. However, longer front-to-rear wheel distance also means larger walker footprint that is not desirable for walking in a small space, storage and transportation. So preferably the front-to-rear wheel distance is selected to substantially prevent forward tipping and backward tipping and to allow the walker be used in substantially small space. Another consideration is the positioning of forearm gutters 138A-B in the side-to-side direction. In general, the gutters need to be placed between the two side frames to effectively prevent sideway tipping. Accordingly, it is preferable to optimize front-to-rear wheel distance and other dimensions for stability in any useful manner known in the art. Preferably, the front-to-rear wheel center-to-center distance is 20-30 inches, the distance between the front wheel centerline to the centerline of forearm gutters is 13-18 inches, and the center of each gutter is located inside of the walker and 1-3 inches from the center plane of the respective side frame.

The inventor has considered ergonomics and user comfort in optimizing the apparatus of this disclosure. Upper body support 128 is thus constructed to best fit user's body structure. Upper handle support tubes 142A-B and forearm gutters 138A-B are tilted upward in the rear-to-front direction about 10-20 degrees. The top view of FIG. 3 reveals that an angle is formed between the centerline of left forearm gutter 138A (and left upper handle support tube 142A) and the centerline of right forearm gutter 138B (and right upper handle support tube 142B). The angle is preferably about 0-40 degrees. The upward tilt and angle between the forearm gutters (and the upper handle support tubes) are to ensure that the left and right forearms and hands of the user are comfortably placed. Furthermore, the tires on wheels 106A-D are made of soft rubber or foamed rubber and with large enough size to absorb vibration caused by rough terrain. And handles and forearm gutters are also made of soft materials, such as self-skinning polyurethane foam, injection molded EVA foam, extruded thermoplastic rubber foam, for user's comfort.

Seat system 300 can provide the user with other conveniences. For example, when the seat is moved to and located at the anterior position it may be used to carry items, such as a shopping bag, when a user is walking inside it. Or, it may serve as a coffee table on occasion.

Figure 16:
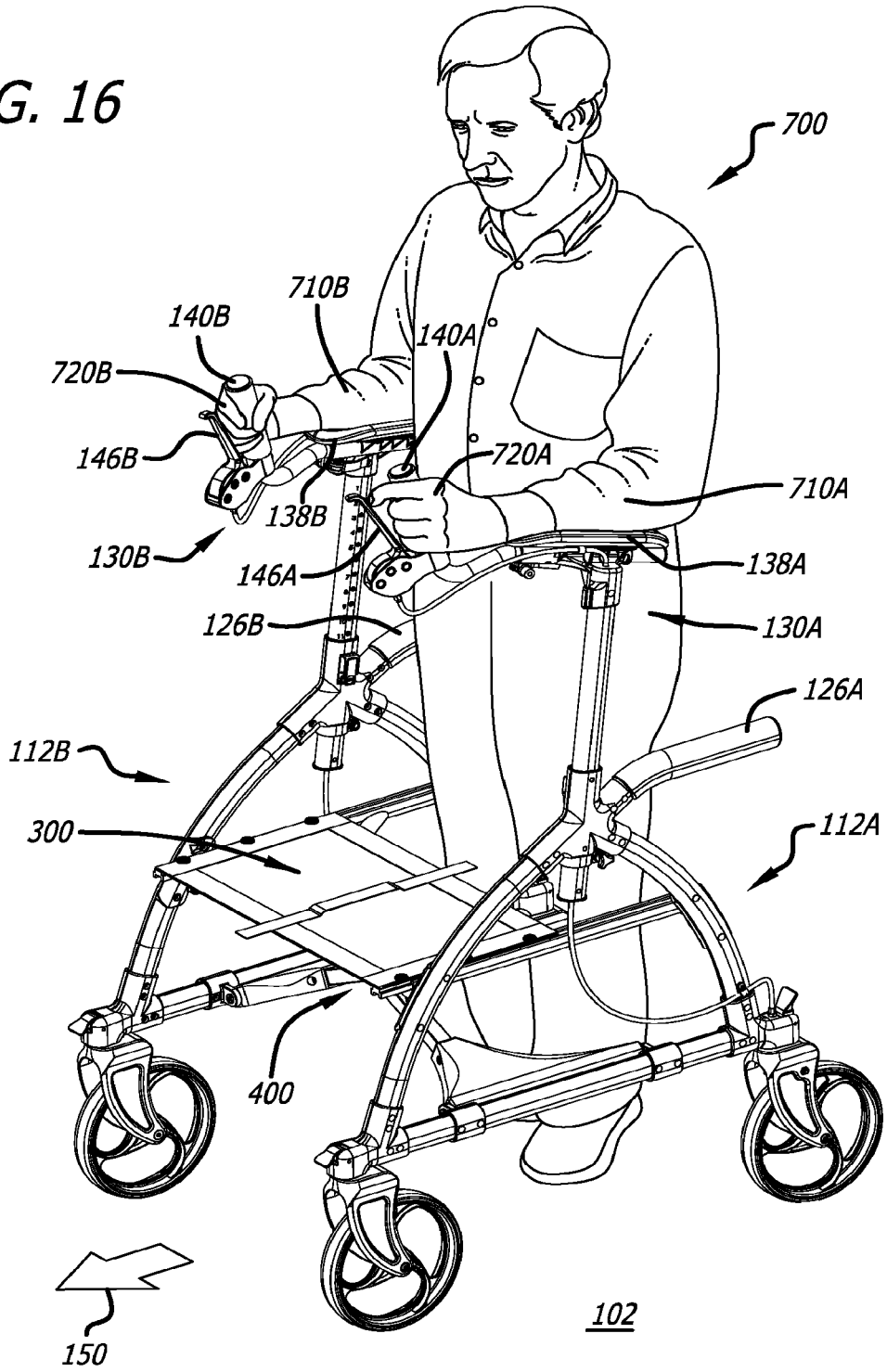
FIG. 16 is a perspective view of the wheeled walker of FIG. 1 with a user inside and operating the walker.

Referring to FIG. 16, user 700, having a left forearm connected to a left hand and a right forearm connected to a right hand, is inside and operating wheeled walker apparatus 100 of FIG. 1. User 700 may be an adult male as depicted in FIG. 16, or may be an adult female. It may also be a child as long as the walker is a good fit for her or him. When user 700 uses wheeled walker 100, due to her or his health condition she or he may start from a sitting position, for example, in a wheelchair or another type of sitting device. User 700 will first grasp and hold onto lower handles 126A-B, stand up, and step into wheeled walker 100. She or he will move seat member 302 forward to the anterior position to form an ample walking space and span 160 within the walker. Then user 700 will place her or his forearms 710A-B in forearm gutters 138A-B and will hold onto upper handles 140A-B with her or his hands 720A-B, and start to make steps in forward moving direction 150. When needed, user 700 can stop wheeled walker 100 by pulling back brake levers 146A-B. During walking user 700 can maneuver wheeled walker 100 by pushing upper handles 140A-B and forearm gutters 138A-B sideways. Then front wheels 106A-B will turn left or right accordingly. When user 700 wants to take a rest and sit down, she or he will first put brake levers 146A-B in parking positions by pushing brake levers 146A-B forward. Then she or he will move seat member 302 backward to the posterior position, turn around and sit down.

Figure 4:
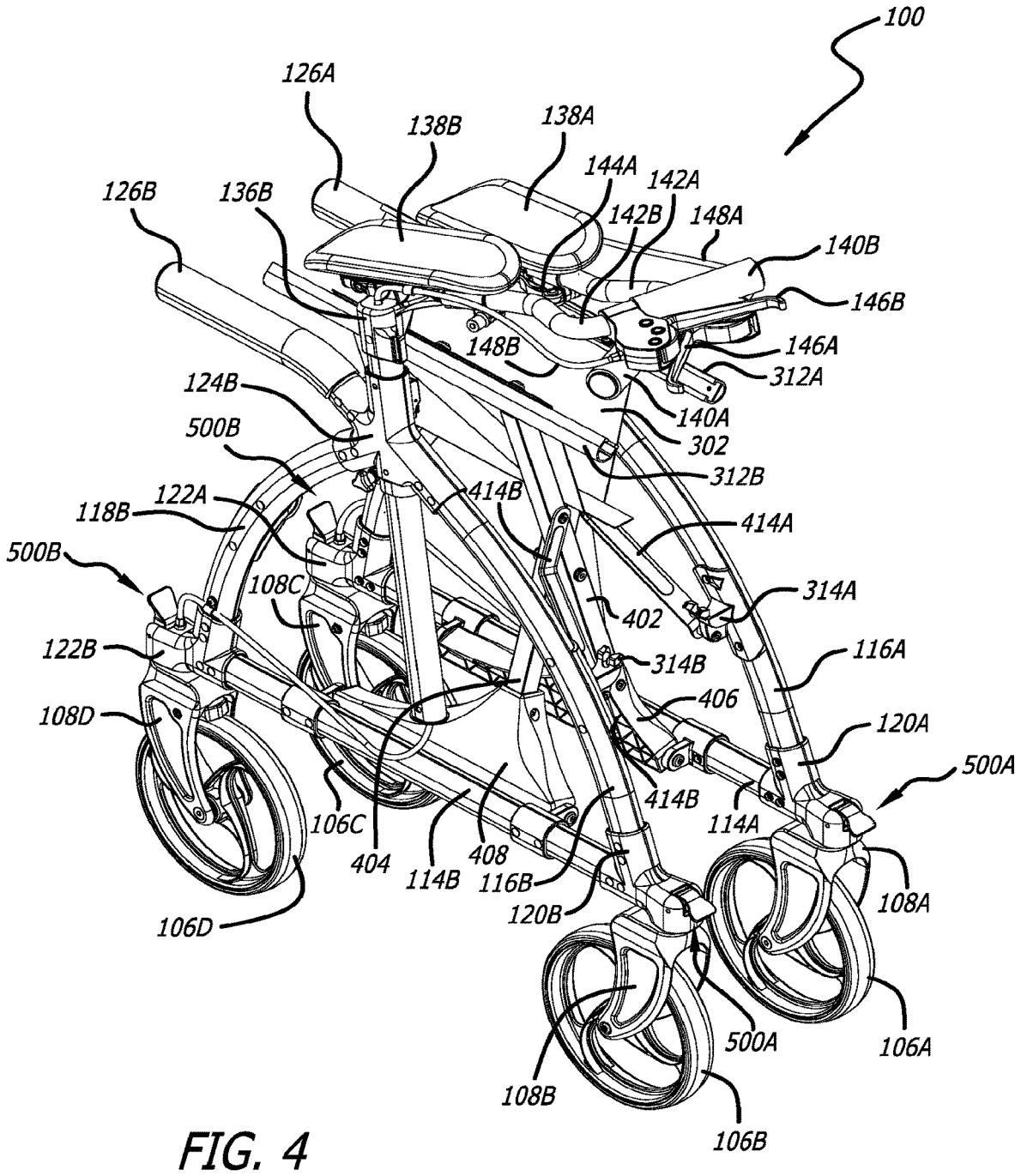
FIG. 4 is perspective view of the wheeled walker of FIG. 1 at its folded state, wherein the two side frames are collapsed toward each other, the upper body support is lowered to the lowest position, and the upper handles are folded.

Referring back to FIG. 4, the same wheeled walker apparatus 100 is shown, but in a folded state. One may see in FIG. 4 that anterior bar 402 and posterior bar 404 are at their near vertical positions. And seat rails 312A-B are out of front seat rail holders 314A-B and rear seat rail holders 316A-B, and are located much higher than the rail holders. As such, wheeled walker 100 is collapsed to a minimal side-to-side width. The side-to-side folding happens when the user holds on seat handle 304 and pulls upward. The pulling force causes seat rails 312A-B to pop out of front seat rail holders 314A-B and rear seat rail holders 316A-B, pulling the side frames toward each other through lower hinges 410A-D and linkage bars 414A-B. Also in FIG. 4 upper body support 128 is lowered to the lowest position, and upper handles 140A-B are turned toward each other to fold. Upper handles 140A-B may also be folded downward to achieve similar effect. As such, wheeled walker 100 is reduced to a minimal height. When fully folded, wheeled walker 100 stands on a small area and takes a small space for storage.

The weight of wheeled walker 100 is another important factor for portability. To achieve lightweight and proper strength, tubular structures are preferred for the main structures, such as the side frames and the upper body support tubes. Preferably these tubular structures are made of light in weight materials, such as aluminum alloys 6061 or 6063. And, preferably the connection joints are made of molded plastic for weight and strength considerations. As such, the folded walker with lightweight may be easily handled, including being lifted up and loaded in a car trunk or a van for transportation.

Figure 5:
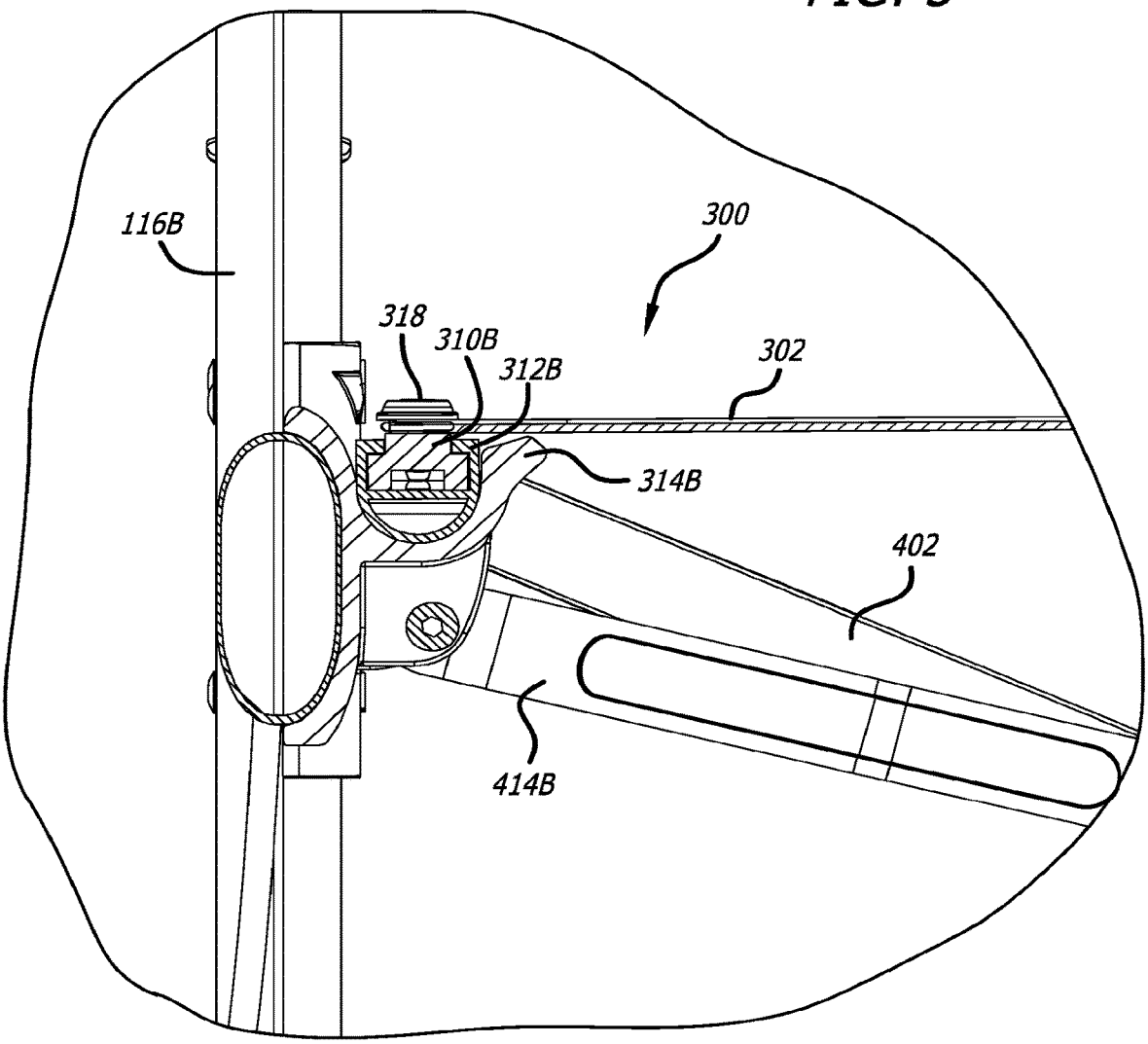
FIG. 5 is a partial cross-sectional view of the wheeled walker of FIG. 1 taken along the line of 5-5, showing details of the slidable seat.

FIG. 5 is a partial cross-sectional view of seat system 300 taken from FIG. 1 along line 5-5 to reveals structural details of the right side of seat system 300. Seat member 302 preferably has a flexible material known in the art made of fabric such as polyester, linen or canvas, or faux leather or leather, or other suitable materials that are flexible and strong. In FIG. 5, the right side edge of seat member 302 is attached to seat slider 310B by screws 318. Seat slider 310B is held inside the slotted channel of seat rail 312B. The slotted channel is a T-channel that has a larger internal space than the opening, so that the T-shaped seat slider 310B cannot escape. The slotted channel may also be a dovetail groove channel to match a similar cross-sectional shape of seat slider 310B. As such, seat slider 310B can slide in seat rail 312B along the length direction but will not separate from it. When wheeled walker 100 is at the open state, seat rails 312A-B (FIG. 1) are pushed in and held tightly by respective seat rail holders 314A-B and 316A-B for stability during walking. When the user pulls up seat handle 304 to close wheeled walker 100, the flexible seat system 300 is folded up and seat rails 312A-B are pulled out of respective seat rail holders 314A-B and 316A-B and are collapsed upward and toward each other. This action causes the pivotally connected anterior bar 402 and posterior bar 404 to rotate about each other for folding.

Figure 6:
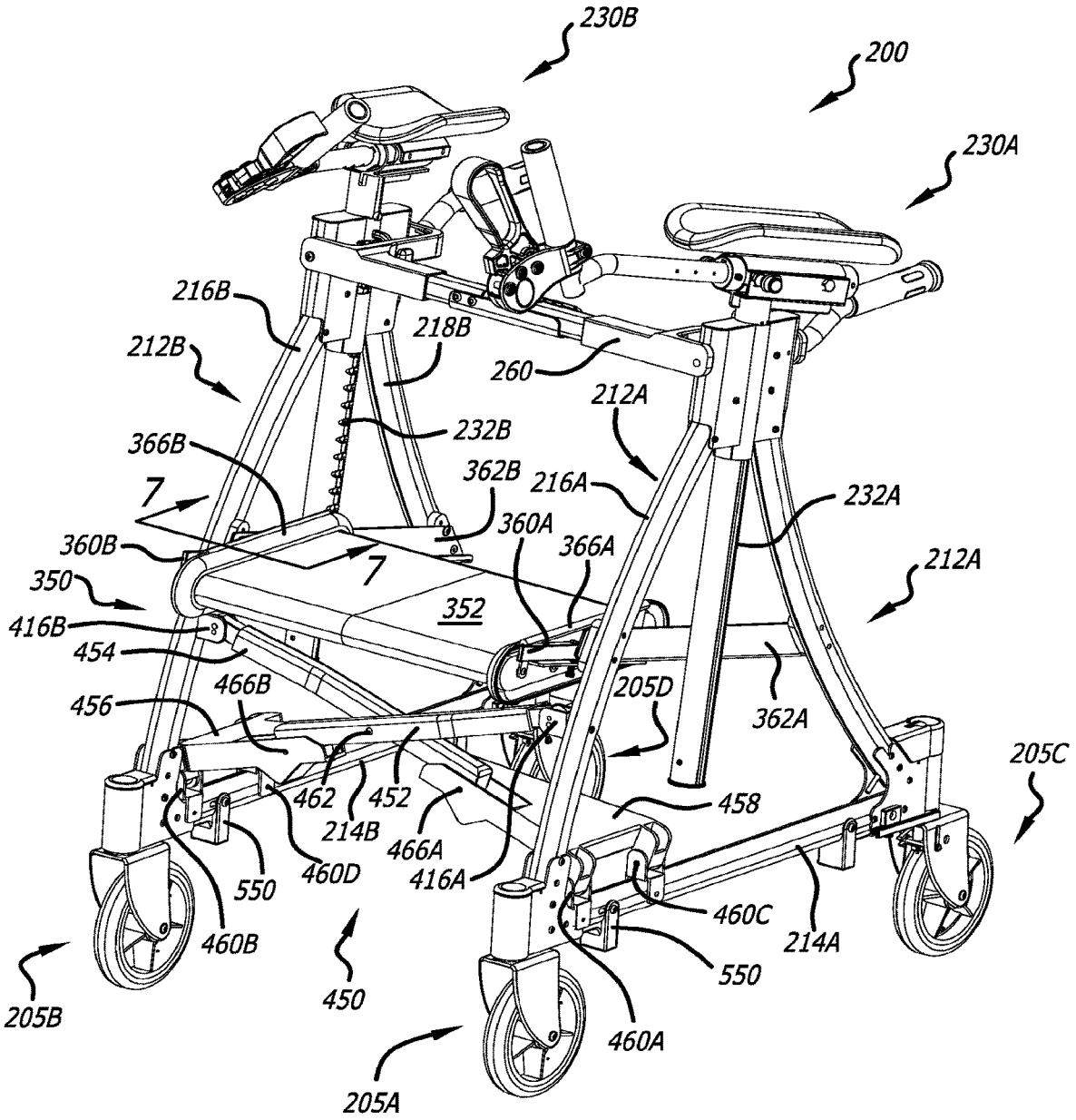
FIG. 6 is a perspective view of an alternative embodiment of the wheeled walker of FIG. 1, with two side frames, four wheel assemblies, two upper body supports, an X-folder, and a slidable seat disposed between the side frames.

Wheeled walker apparatus 200 of FIG. 6 is an alternative embodiment of wheeled walker 100 of FIG. 1. Similar structures including side frames 212A-B, side upper body supports 230A-B, and wheel assemblies 205A-D are shown. The heights of upper body supports 230A-B are adjusted with the help of height adjustment tubes 232A-B. However, seat system 350 and X-folder 450 show peculiar differences comparing to the equivalent structures in wheeled walker 100 of FIG. 1. And, to enhance walker stability, a collapsible bridge 260 is built between the upper portions of side frames 212A and 212B. As such, height adjustment of upper body supports 230A-B is coordinated.

In FIG. 6, X-folder system 450 includes an anterior bar 452 that is rotatably connected to a posterior bar 454 by a center hinge 462. Anterior bar 452 is rotatably connected at its lower end to an anterior delta plate 456 by a mid-low hinge 466B, and anterior delta plate 456 is in turn rotatably connected to a frame horizontal tube 214B of side frame 212B by lower hinges 460B and 460D. The upper end of anterior bar 452 is rotatably connected to a frame front tube 216A by an upper hinge 416A. Posterior bar 454 is rotatably connected at its lower end to a posterior delta plate 458 by a mid-low hinge 466A, and posterior delta plate 458 is in turn rotatably connected to a frame horizontal tube 214A of side frame 212A by lower hinges 460A and 460C. The upper end of posterior bar 454 is rotatably connected to a frame front tube 216B by an upper hinge 416B.

By rotating anterior bar 452 and posterior bar 454 with respect to each other pivoting center hinge 462, anterior bar 452 and posterior bar 454 either move toward near vertical positions or move toward near horizontal positions, as in the case of X-folder 400 on wheeled walker 100 of FIG. 1. Since the upper end of anterior bar 452 is connected to side frame 212A and the upper end of posterior bar 454 is connected to side frame 212B, the height of these upper ends will not change during movement. Instead, when anterior bar 452 and posterior bar 454 move to collapse toward each other, such a movement pushes the lower ends of anterior bar 452 and posterior bar 454 to go lower in height, accomplished by pivotal movement at mid-low hinge 466B and mid-low hinge 466A between each bar and the respective delta plate. Consequently, X-folder 450 is being collapsed and folded. On the other hand, when anterior bar 452 and posterior bar 454 move toward near horizontal positions, the movement straights out the bends at mid-low hinges 466A-B. X-folder 450 is therefore being opened.

In FIG. 6, seat system 350 includes a seat member 352 that has a left side edge 366A and a right side edge 366B, two seat sliders 360A-B, and two sloped seat rails 362A-B. By virtue of the function of X-folder 450 described above, the edges of seat system 350 stay at the same height at the walker's open state and folded state. Seat member 352 of wheeled walker 200 is made of a rigid material, such as aluminum alloy, steel, molded plastic, wood, or bamboo, or any other suitable rigid material that is known in the art. And seat member 352 includes two side panels connected by a hinge (not shown) at the centerline at the bottom side. Therefore, seat member 352 folds up when X-folder 450 is collapsed. In an alternative embodiment, seat member 352 includes two side panels and a mid-panel that are connected in turn by hinges at the bottom side. This three panel seat results in reduced seat height when folded as compared to that of the two panel design. Seat member 352 may also be made of flexible material like seat member 302 on wheeled walker 100 of FIG. 1. And such a flexible seat may be supported by a rigid and foldable frame from underside.

When seat member 352 moves along seat rails 362A-B to its posterior position for sitting and the anterior position for walking, the height of the seat changes due to the sloped seat rails. The angle of the sloped seat rails is determined to fit the proper sitting height while proving a front seat height for other conveniences.

As with X-folder 400 of in wheeled walker 100 of FIG. 1, X-folder 450 in wheeled walker 200 of FIG. 6 has delta plate 456 that is pivotally connected to frame horizontal tube 214B of side frame 212B by lower hinges 460B and 460D, and delta plate 458 that is pivotally connected to frame horizontal tubes 214A of side frame 212A by lower hinges 460A and 460C. The horizontal distance between hinges 460B and 460D and that between hinges 460A and 460C are made relatively large. As such the lower portion of left frame 212A and the lower portion of right frame 212B are kept substantially parallel to each other. The upper portions of left frame 212A and right frame 212B are supported by the rigid seat 352 or the rigid seat frame under the seat if seat 252 is flexible and seal rails 362A-B. Thus the left and right side frames are kept parallel and the whole frame is stable during use. And this stability is especially important when walking surface 102 is bumpy. As with walker 100 of FIG. 1, the components of the frame and other feature are constructed with strong and light in weight materials known in the art.

Figure 7:
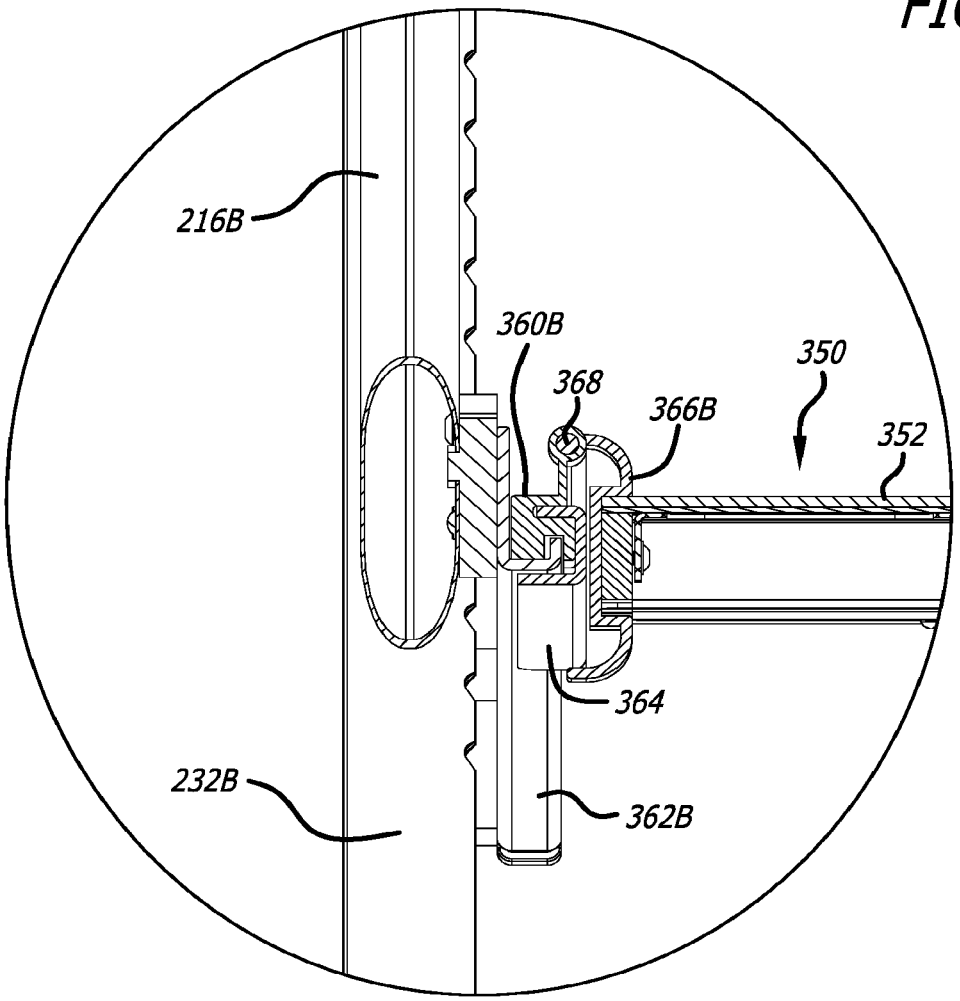
FIG. 7 is a partial cross-sectional view of the wheeled walker of FIG. 6 taken along the line of 7-7, showing details of the slidable seat.

The cross-sectional view taken along the line 7-7 in FIG. 6 is shown in FIG. 7 to reveal the sliding structure of the right side of seat system 350. Seat member 352 is connected to seat edge 366B that is rotatably connected to seat slider 360B by hinge 368. Seat slider 360B rides on seat rail 362B that is affixed to right side front tube 216B and right side rear tube 218B (FIG. 6). Further, a seat rail shield 364 is attached to seat slider 360B to ensure that seat slider 360B will not be separated from seat rail 262B. As such, seat member 352 can move along the length direction of the rail to an anterior position that forms ample span for walking, and to a posterior position for the user to sit on and take a rest when needed.

One of ordinary skill in the art will appreciate that the slidable seat disclosed in FIGS. 1-7 may also be constructed in a walker that is not foldable side-to-side but does have left and right side frames. In such case, the side rails are attached to and supported by the side frames. The seat member may be made of flexible or rigid material. When it is made of rigid material, it may consist one panel because no folding is needed. The walker with a slidable seat may have upper handles but no forearm rests, as with most of the walkers on the market. In this case, the handles may take different shape and orientation. For example, the slidable seat may also be a part of a simpler walker with less than 4 wheels to benefit users.

Figure 8:
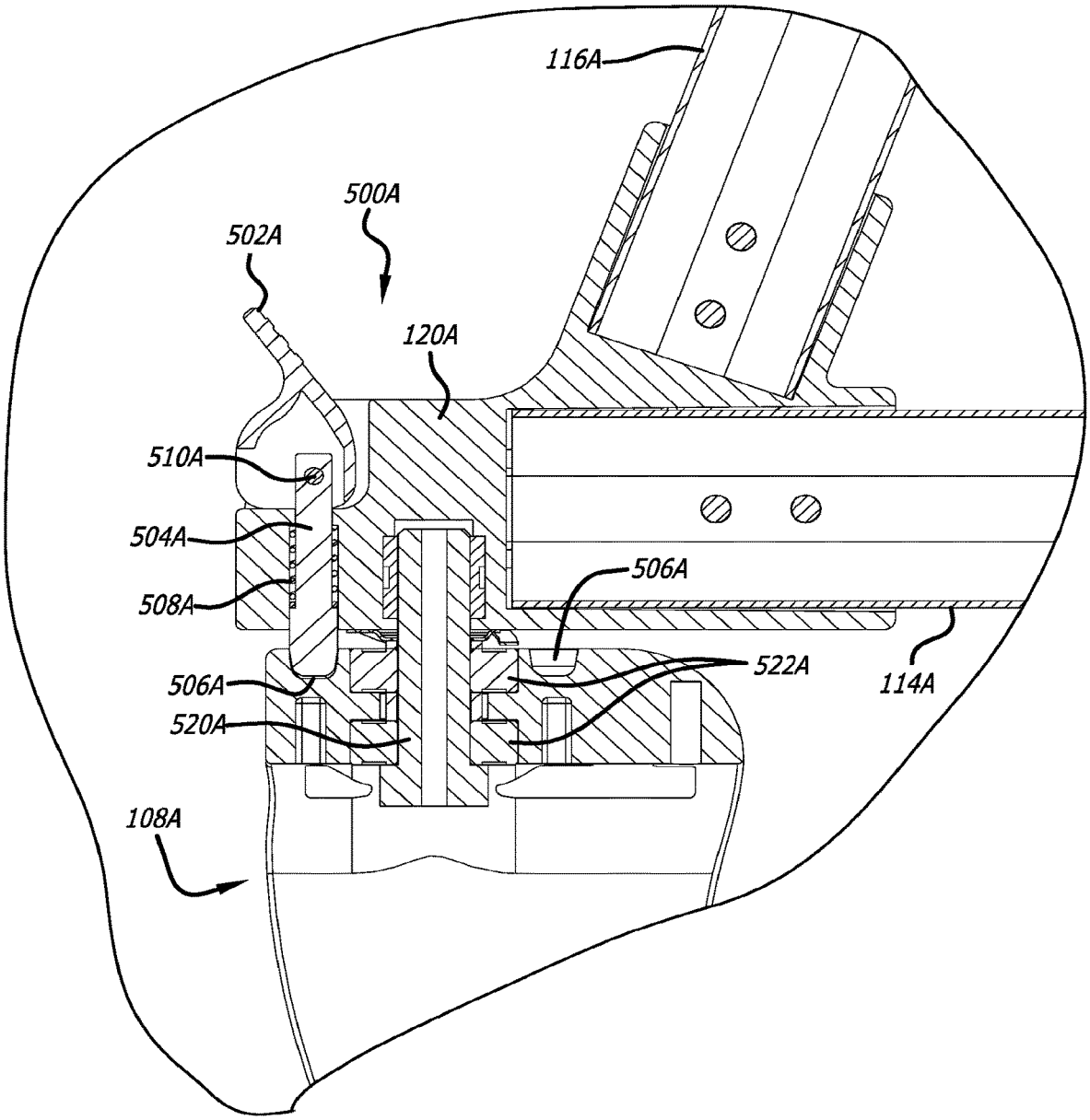
FIG. 8 is a partial cross-sectional view of an embodiment of the wheel direction lock for the wheeled walker of FIG. 1.
Figure 12:
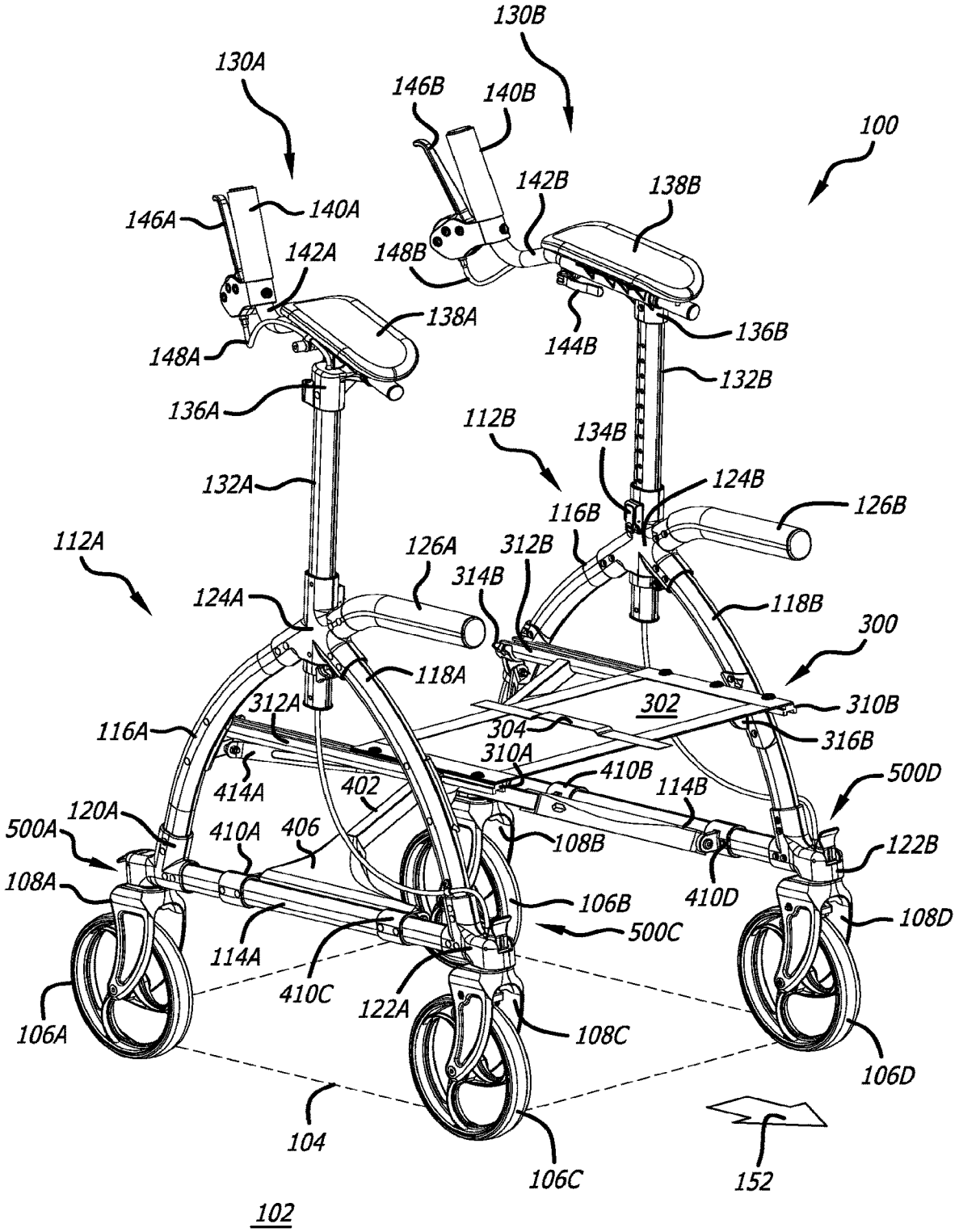
FIG. 12 is a perspective view of the wheeled walker of FIG. 1, wherein the walker is converted to a transport chair by configuring the front and rear wheel direction locks accordingly.

Going to FIG. 8, a partial cross-sectional view of wheel direction lock 500A is taken from the structure of either frame front joints 120A or 120B that is disposed above the respective front wheel 106A or 106B and respective front wheel fork 108A or 108B. Since front wheels 106A-B together with their supporting structures including wheel forks, frame front joints and wheel direction locks are equivalent to each other, the structures revealed in FIG. 8 are those above front wheel 106A to represent both. In FIG. 8, wheel direction lock 500A includes a lock lever 502A, a lock pin 504A, a lock compression spring 508A, and a lock shaft 510A. Lock lever 502A resides on the top side of frame front joint 120A in a cavity, and is rotatably connected to lock pin 504A by lock shaft 510A. Lock pin 504A goes through a hole in frame front joint 120A to reach the lower side. The hole in joint 120A is a step hole with the smaller section on top of the larger section. And pin 504A is a step rod with the larger section below the smaller section. In this way, a circular space is created between these two parts, and lock spring 508A is compressed and sandwiched between them. The spring force from compression spring 508A acts to push lock pin 504A downward. It is to be noted that the bottom portion of lock lever 502A has a cam-like structure, so that flipping lock lever 502A up and down coupled with spring force from lock spring 508A acts to move lock pin 504A down and up. Below wheel direction lock 500A and frame front joint 120A is wheel fork 108A that is rotatably connected to frame front joint 120A through fork shaft bearings 522A and fork shaft 520A. Wheel fork 108A has two holes 506A having matching shape to receive lock pin 504A on the top surface. When lock lever 502A is flipped down either by finger or by foot, lock pin 504A is pulled upward by the cam structure. As such, lock pin 504A is not in contact with wheel fork 108A, and wheel fork 108A can therefore freely turn around fork shaft 520A. At this condition wheel direction lock 500A operates in a pseudo-stable state because compression spring 508A has the tendency to urge lock pin 504A to move downward to the more stable state. At another time when lock lever 502A is flipped up, the spring force from lock spring 508A urges lock pin 504A to move downward and press on the top surface of wheel fork 108A. As wheel fork 108A turns around fork shaft 520A during use, one of the lock holes 506A comes right under lock pin 502A, so that lock pin 502A is inserted into lock hole 506A. As such, wheel fork 108A is locked to cause the connected wheel to move in a fixed straight direction. Since there are two lock holes 506A on the top surface of wheel fork 108A, the wheel may take one of the two orientations when locked: locking pin 502A into one causes the wheel to be biased to point to the rear end of walker 100 (FIG. 1); locking pin 502A into the other causes the wheel to be biased to point to the front end of the walker (FIG. 12). It is to be noticed that in general locking the wheel to point to the rear end is friendly for walker 100 to move in the forward moving direction 150 (FIG. 1), while locking the wheel to point to the front end is friendly for the walker to move in the rearward direction 152. (FIG. 12). Also, it is possible to have more than two lock holes 506A or the holes may take different orientations so that the connected wheel may be locked to move in a direction that is not straight forward or backward.

Figure 9:
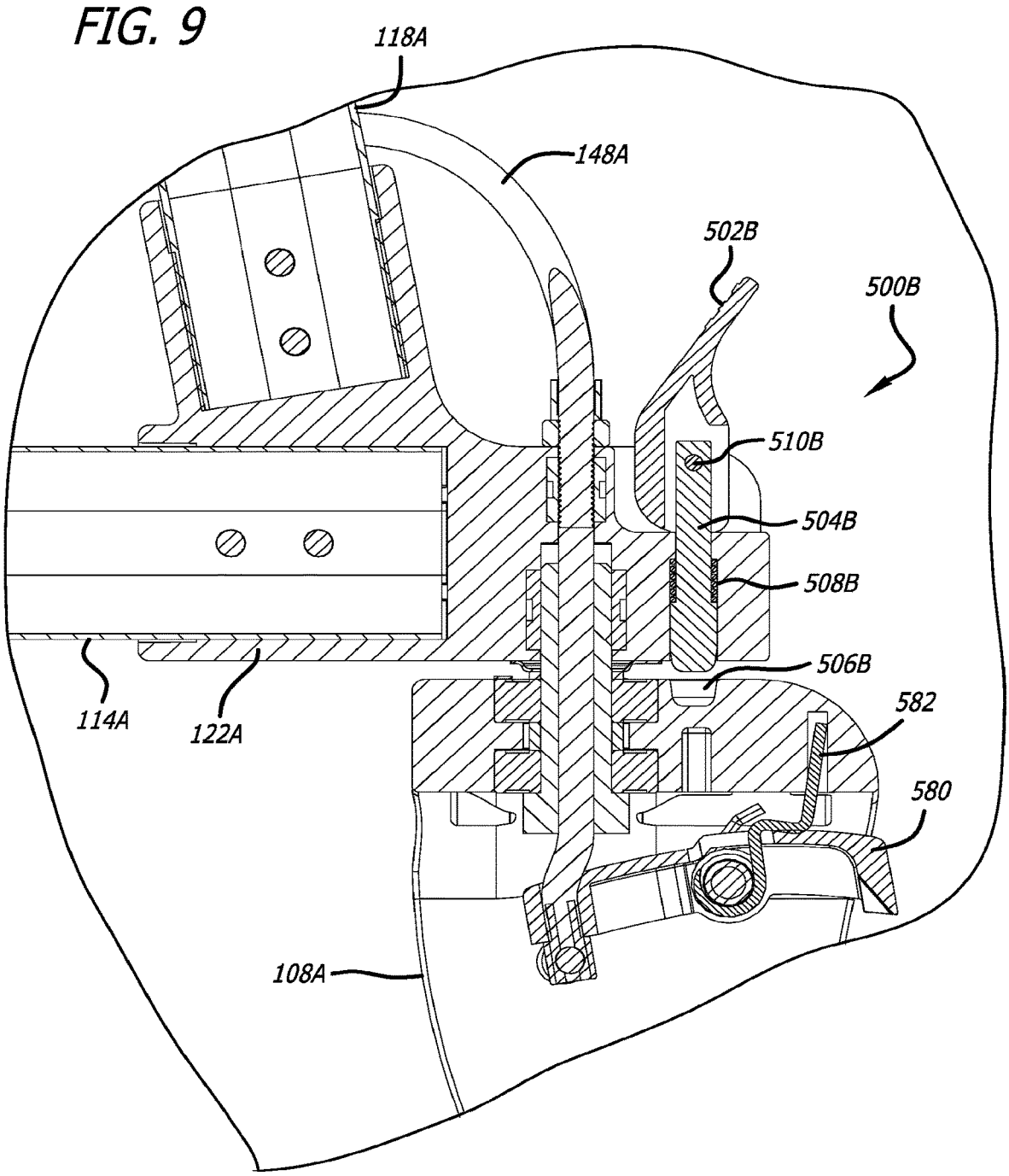
FIG. 9 is a partial cross-sectional view of another embodiment of the wheel direction lock for the wheeled walker of FIG. 1.

An alternative embodiment of wheel direction lock 500A is shown in FIG. 9 as 500B, a partial cross-sectional view taken from wheel walker 100 in FIG. 1 at one of frame rear joint 122A or 122B. As with 500A described above, the structures shown in FIG. 9 are those above rear wheel 106A. Wheel direction lock 500B includes a lock lever 502B having a cam, a lock pin 504B, a lock compression spring 508B, and a lock shaft 510B. All the components function the same as with wheel direction lock 500A, except for lock lever 502B due to the structural difference of the cam. Comparing to 500A where flipping up lock lever 502A causes the pin to insert into lock hole 506A and locks the wheel below, when lock lever 502B is flipped up, lock pin 504B is pulled upward to allow the wheel to turn freely. And when flipped down, the spring force from lock spring 508B urges lock pin 504B to move downward to insert into hole 506B, so as to lock the direction of wheel fork 108C and consequently the wheel below.

Therefore, wheel direction lock 500A of FIG. 8 and wheel direction lock 500B of FIG. 9 function the same except they have different normal function states as indicated by lock lever 502A-B at the normally down position: for 500A when lock lever 502A is down wheel is unlocked and turns freely; for 500B when lock lever 502B is down wheel is locked to move in fixed straight direction.

Figure 10:
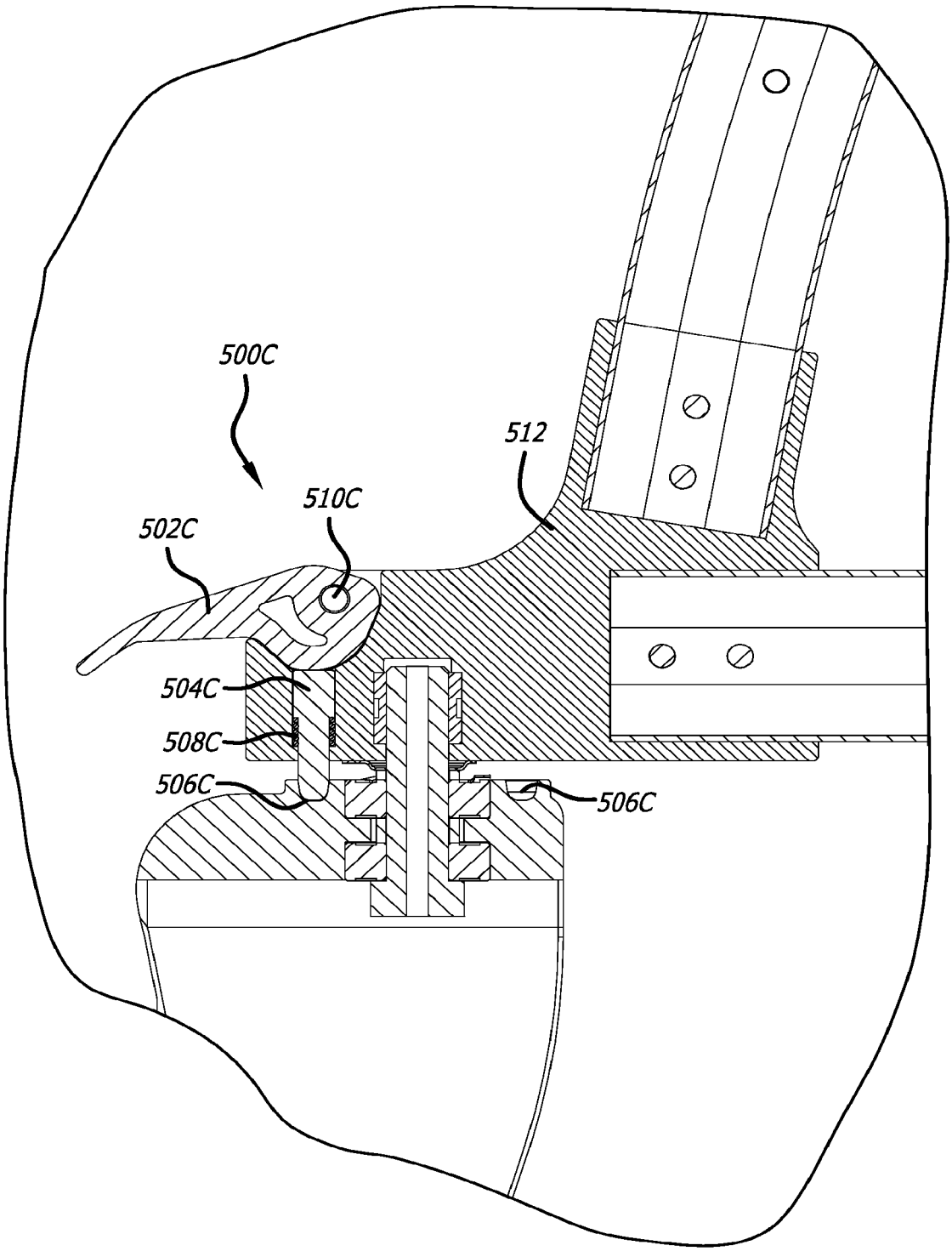
FIG. 10 is a partial cross-sectional view of yet another embodiment of the wheel direction lock for the wheeled walker of FIG. 1.

FIG. 10 shows 500C, another embodiment of wheel direction lock 500A of FIG. 8. As with the two alternatives discussed above, a lock lever 502C resides in a cavity of a frame joint 512. But instead of connecting to the pin, lock lever 502C is rotatably connected to frame joint 512, and is in slidable contact with a lock pin 504C. Another difference between 500C and the above discussed alternatives 500A and 500B is the way a lock spring 508C is arranged. The step hole in frame joint 512 and the step rod of lock pin 504C are in opposite directions of those in wheel direction locks 500A and 500B. Therefore, the spring force from compression spring 508C sandwiched in the space defined by lock pin 504C and the hole in joint 512 acts to urge lock pin 504C to move upward. As such, when lock lever 502C is flipped down, it pushes down lock pin 504C to actively enter into a lock hole 506C in order to lock the wheel below. When lock lever is flipped up, on the other hand, lock pin 504C is pushed up by the spring force from lock spring 508C. As such the wheel below is unlocked. One of ordinary skill in the art will appreciate that for lock lever 500C to lock a wheel 106A-D (FIG. 1), lock pin 504C and lock hole 506C have to be aligned for the active engagement to happen. This is a disadvantage for walker operation.

Figure 11:
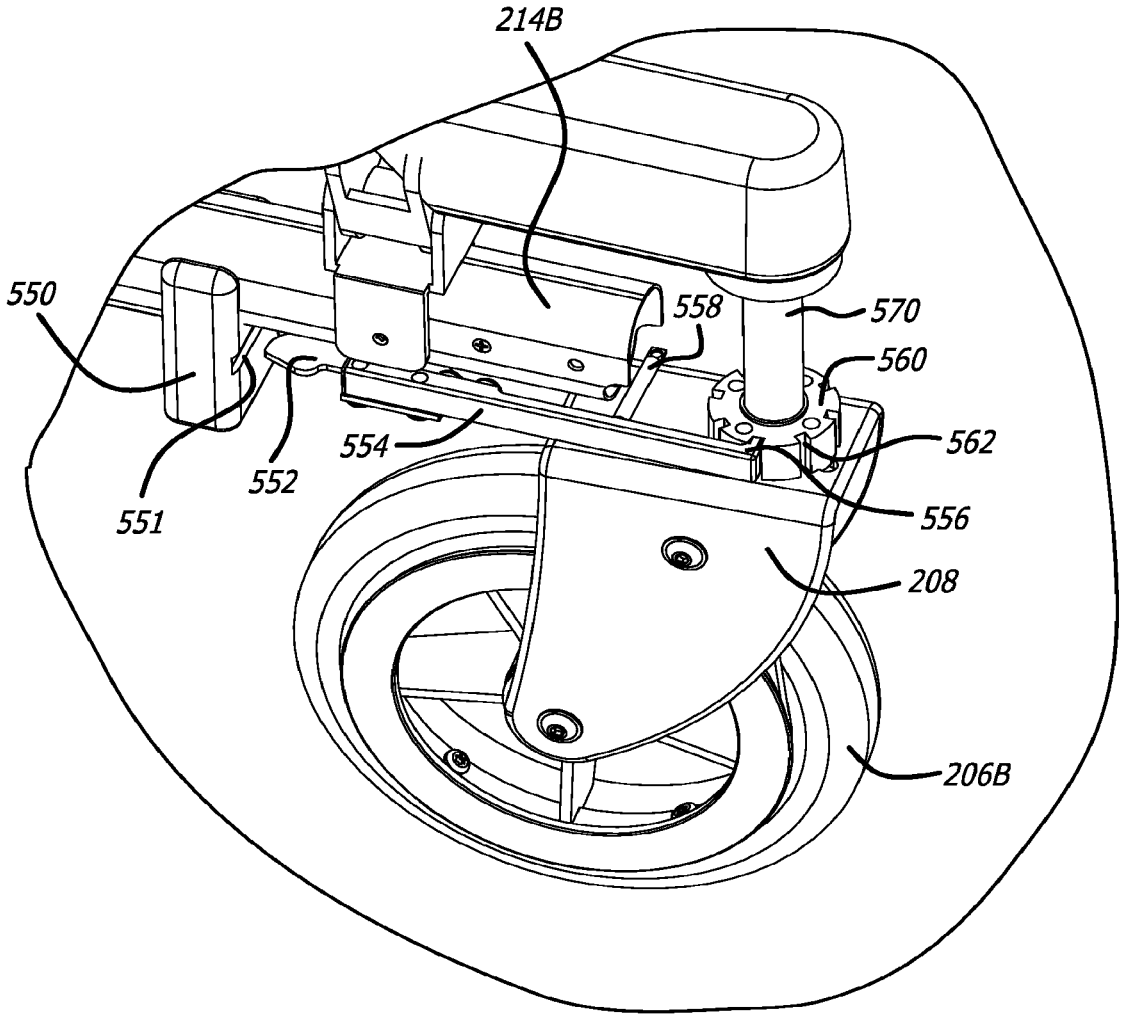
FIG. 11 is a close-up perspective view of an embodiment of the wheel direction lock for the wheeled walker of FIG. 6, with surrounding parts removed to reveal details.

In FIG. 11, another embodiment of wheel direction lock is shown as 500D that is a close-up view taken from the right front part of wheeled walker 200 of FIG. 6, to exemplify the structures. Wheel direction lock 500D includes a lock toggle switch 550 having an activating opening 551, a lock bar 554 that is connected to an activating plate 552. Lock bar 554 has a bended lock finger 556 that readily enters one of the pluralities of lock grooves 562 around the outer circumference of a lock disc 560, that is affixed to a fork shaft 570 affixed to wheel fork 208. Activating plate 552 has two angled edges to form a hump in order to interface activating opening 551 in toggle switch 550. Lock bar 554 is rotatably connected to frame horizontal tube 214B, and the action of moving lock finger 556 to bite into one of the lock grooves 562 is caused by a lock extension spring 558. When toggle switch 550 is kicked toward wheel 206B by a user's foot (not shown), activating opening 551 is first in touch with the front sloped edge of activating plate 552 and pushes activating plate 552 in the direction normal to the sloped edge, transferring a lever effect to lock bar 554 to overcome the spring force from extension spring 558, causing lock finger 556 to move out of lock groove 562. When the hump on activating plate 552 enters activating opening 551, it stays a pseudo-stable state. As such, wheel 206B is unlocked and may turn freely for wheeled walker operation. At a different moment when toggle switch 550 of wheel direction lock 500D is kicked in the direction away from wheel 206B, activating plate 552 moves out of the activating opening 551 on toggle switch 550. Then lock spring 558 acts to pull on lock bar 554, causing lock finger 556 at the far end of lock bar 554 to press on the circumference of lock disc 560. As wheel 206B turns during walker operation, lock disc turns and a lock groove 562 will come to receive lock finger 556. Thus, wheel direction is locked. It is to be noted that the number of lock grooves 562 on lock disc 560 determines that wheel 206B may be locked to move in the number of directions. For example, only one groove is needed to achieve the free wheel turning and locked straight forward movement, to be equivalent to the function of wheel direction lock 500B shown in FIG. 9.

In the embodiments of wheel direction locks shown in FIGS. 8-11, the lock action is achieved through the insertion of a pin into a hole or the insertion of a finger into a hole. One of ordinary skill in the art will appreciate that this lock action between the walker frame and the wheel assembly thereunder may be achieved by the combination of a protruding lock element on one side of the moving structure and a matching denting lock depression on the other side of the moving structure. The mating of the lock element and the lock depression causes the wheel direction to be locked with the frame above, and the un-mating of the lock element and the lock depression allows the wheel to freely turn.

Wheel direction lock 500A-D, as discussed above in connection with FIGS. 8-11, may be adapted to satisfy different user needs. For example, wheel direction locks 500A and 500B on walker 100 of FIG. 1 may be adapted for one purpose. Other embodiments, such as 500C and 500D disclosed above, may be adapted for other purposes. A user may prefer to set the front wheels to turn freely and to lock the rear wheels to move in straight line. In this way, the walker user can exert force on upper body support 128, including upper handles 140A-B and on forearm gutters 138A-B, to cause the front wheels 106A-B to turn left or right, or to balance the left side and right side to walk straight following moving direction 150 (FIG. 1). For wheeled walker 100 to function in this "normal" mode, wheel direction locks 500A at front wheels 106A-B are unlocked to allow the front wheels to turn freely, and wheel direction locks 500B at the rear wheels 106C-D are locked to allow rear wheels to move in straight line.

A user may experience weakness or even paralysis in one side of the body due to special health conditions such as stroke and neurological disorders. Such a user may struggle to control wheeled walker 100 if the front wheels are configured to turn freely. In this case, all the wheel direction locks, including 500A for the front wheels, may be locked to set wheels 106A-D to move in straight line. It may be necessary for a helper to the user to turn the walker left or right when necessary.

Should a user roll wheeled walker 100 into a small space, he or she may unlock wheel direction locks 500A-B for all four wheels to allow front wheels 106A-B and rear wheels 106C-D to freely turn. With all four wheels freely turning, wheeled walker 100 is most maneuverable and may take the sharpest turn. As another example, if wheeled walker need to be stored or shipped in a box, the front wheels and the rear wheels may be configured to point to each other in order to minimize the front to back length.

FIG. 12 shows a case that wheeled walker 100 of FIG. 1 is converted to a transport chair, with wheels 106C-D unlocked by wheel direction locks 500B. Wheels 106A-B may be locked by wheel direction locks 500A with lock levers 502A flipped up (FIG. 8). In this way, rear wheels 106C-D turn freely, but front wheels 106A-B move in straight direction. Then seat 302 is slid user 700 (FIG. 16) to move it to the rear end or posterior position. The user may then turn around and sit on seat 302. A helper (not shown) may hold upper handles 140A-B and push wheeled walker 100 to move the walker and the user following moving direction 152 that is the opposite of moving direction 150 in FIG. 1. Preferably, foot rests (not shown) are attached to frame rear tubes 118A-B to allow the user to put her or his feet on. Upper handles 140A-B may be turned and locked in orientations that are easy for the helper to hold and push the walker.

Figure 13:
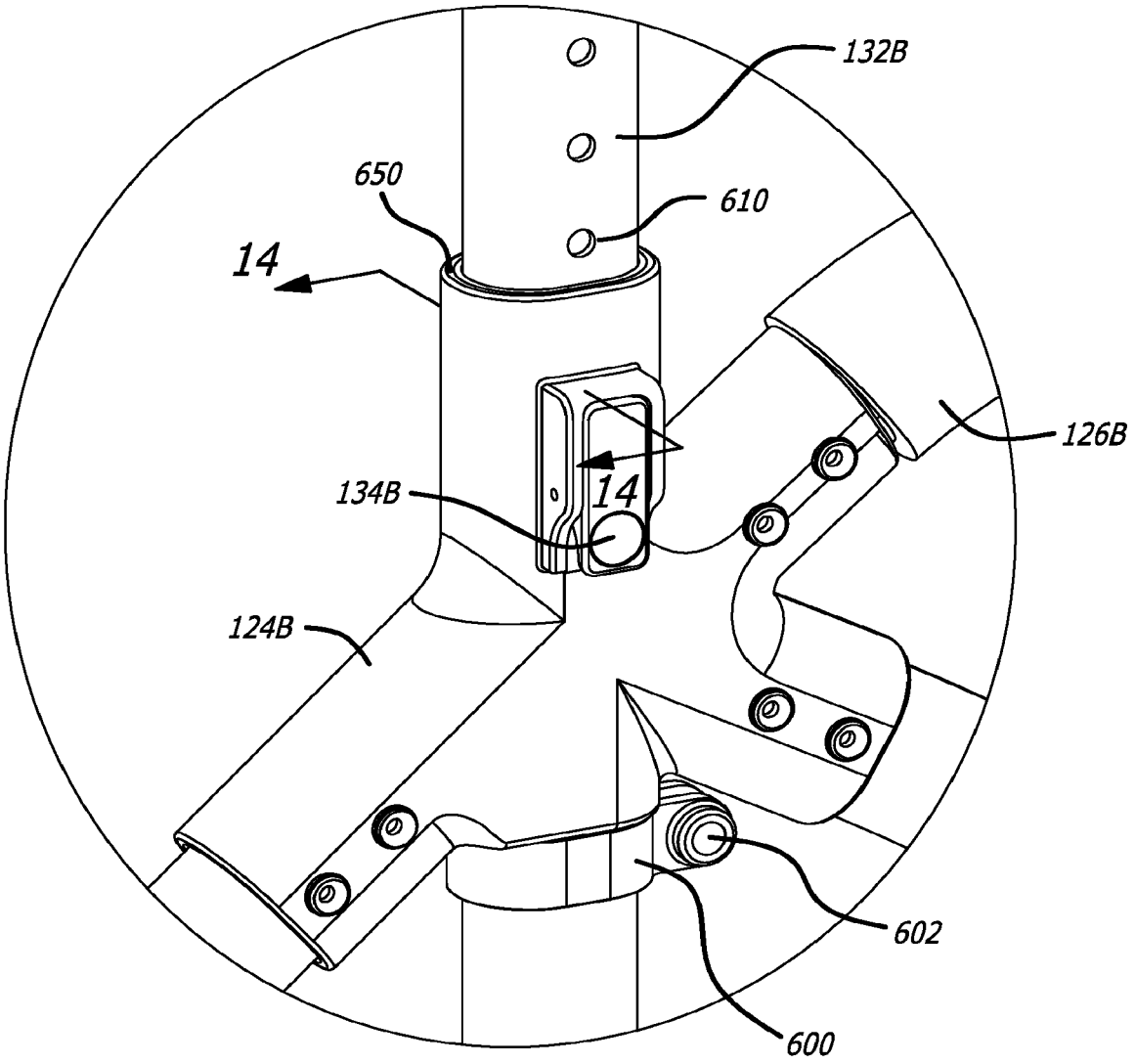
FIG. 13 is a close-up perspective view to show details of a frame top joint of a side frame as engaged with a height adjustment tube, wherein a height memory ring embraces the height adjustment tube at the lower end of the frame top joint.

Referring to FIG. 13, a close-up perspective view of frame top joint 124B is shown, viewing from inside of the walker at an angle. It may be seen that height adjustment tube 132B is threaded through a hole in joint 124B, and the height of right side upper body support 130B (FIG. 1) is adjustable by raising or lowering height adjustment tube 132B relative to joint 124B. The height may then be locked by height adjustment tab 134B.

Figure 14:
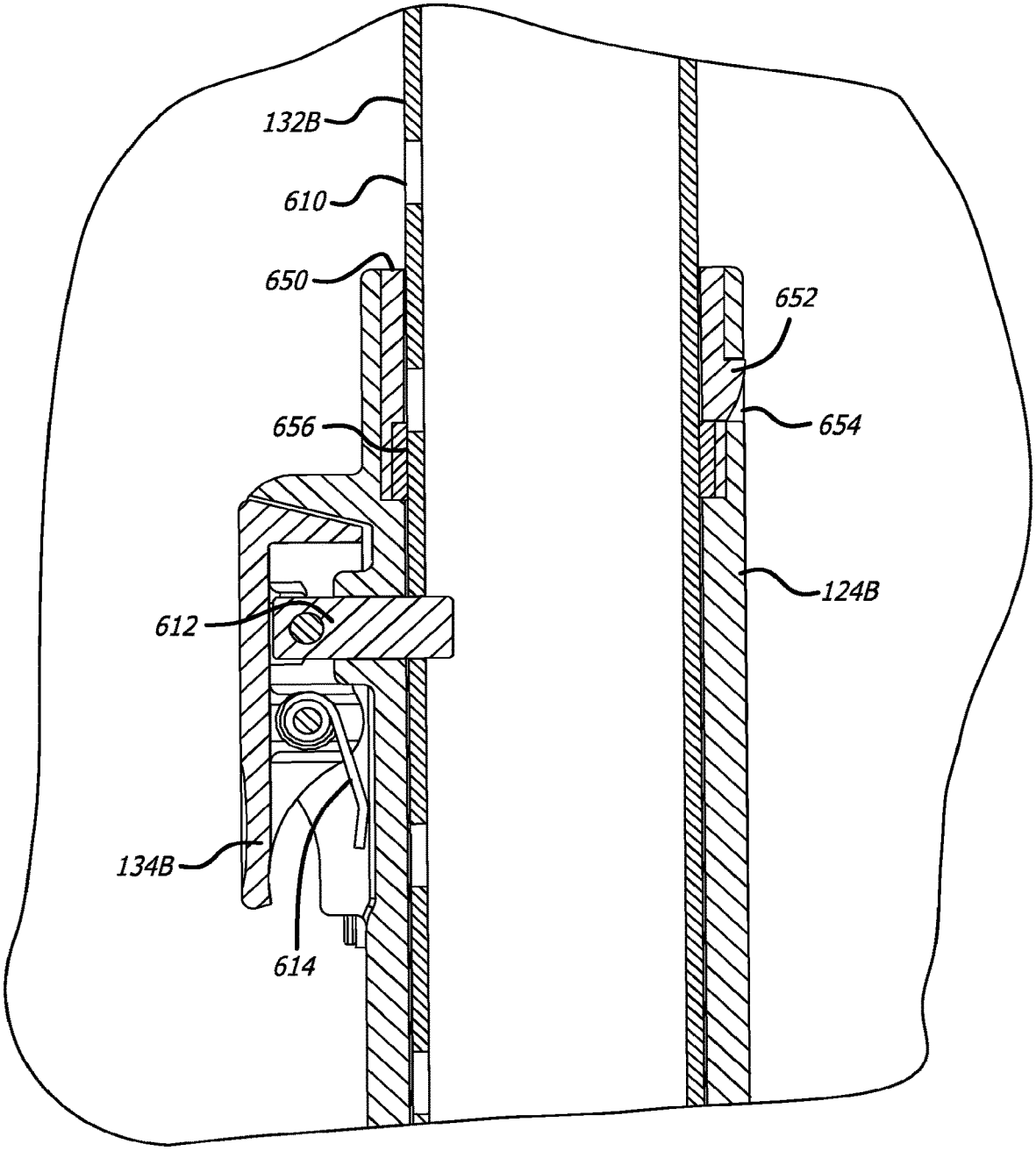
FIG. 14 is a cross-sectional view of FIG. 13, showing internal details of the frame top joint engaged with the height adjustment tab, and a bushing sandwiched therebetween.

FIG. 14 is a cross-sectional view of the perspective view of FIG. 13. Height adjustment tube 132B is held in the hole through frame top joint 124B. And the height is locked by a height adjustment pin 612 that is inserted into one of the series of height adjustment holes 610 on height adjustment tube 132B. A torsion height adjustment spring 614 is connected to height adjustment tab 134B, that is in turn rotatably connected to height adjustment pin 612. Therefore, height adjustment spring 614 acts to exert a force on height adjustment tab 134B to urge height adjustment pin 612 to insert into height adjustment hole 610. It is to be noted that a compression spring or an extension spring may be used to achieve the same effect. To adjust the height of right side upper body support 130B, the user may use one hand to press in height adjustment tab 134B to pull pin 612 out of hole 610, and uses the other hand to raise or lower height adjustment tube 132B relative to joint 124B. When a preferred height is reached, she or he releases height adjustment tab 134B to allow spring 614 to push pin 612 in to a hole 610.

The precise mating between height adjustment tube 132B and the hole in frame top joint 124B is an important feature of the apparatus of this disclosure. The usual manufacturing tolerances create a gap between these two parts. If the gap is too large, upper body support 130B will become loose and wobbling, and the walker user will feel unstable and unsafe during use. So it is preferred that the gap is minimized for user's best satisfaction. However, any dimension of a manufactured part has a tolerance range. For height adjustment tube 132B and the hole in frame top joint 124B, the outer dimension of the tube may fall in a range from part to part, as may the inner dimension of the hole in the joint from part to part. As shown in FIG. 14, a bushing 650 is inserted between the tube and the hole at the mouth, with a latch lock 652 on bushing 650 locked into a side hole 654 on joint 124B. Because such a bushing as a smaller part may be made of special material for better tolerance control, the gap between the tube and the bushing may be better controlled. However, a gap still exists between tube 132B and bushing 650, even if smaller. For one manufacturing batch a part dimension may be at the upper limit of the tolerance range, while for another batch the same dimension may reach the lower limit of the tolerance range. For height adjustment tube 132B and bushing 650, tolerance design is to ensure that height adjustment tube 132B with the outer dimension at its upper limit can go through bushing 650 with the inner dimension at its lower limit. This is necessary to avoid interference between the two parts for the worst case scenario. Inevitably, due to manufacturing variation there will be the case that a height adjustment tube with the outer dimension at its lower limit is inserted into a bushing with the inner dimension at its upper limit. This means that the gap between the two parts to the extreme is equal to the summation of the tolerance ranges of the relevant dimensions of two parts. And the gap may be large enough to cause user stability and safety concern.

A solution to this problem is revealed in FIG. 14, where a step is created at the inner end of bushing 650 opposite to the open end and a gap filler layer 656 is inserted into the space. Gap filler 656 is made of a material that changes volume or thickness under pressure. Such a material may be selected from the group consisting of foam rubber, sponge rubber, rubber with low durometer, loop-side Velcro, and certain types of fabrics such as felt, flannel, and velvet. Gap filler 656 may be a separate part assembled into the space. Or it may be glued to the step section of the inner surface of bushing 650 before the bushing is installed into the hole through frame top joint 124B. Gap filler 656 may take the shape of a ring, or it may be one or more pieces to cover partial circumference of bushing 650. Once installed, the original thickness of gap filler 656 makes the inner dimension of the section of the bushing with gap filler smaller than the outer dimension of tube 132B, and causes an interference when the tube is inserted into the bushing. Then the insertion causes gap filler 656 to be squeezed laterally. As such, the gap filler layer is compressed and conforms to the thickness defined by the outer dimension of the tube. The original thickness of gap filler 656 is selected in such a way to give optimal result of tightness between the tube and the bushing in order to minimize the looseness and wobbling of upper body support 130B. It is preferred that the selected material for gap filler 656 has low friction so that it allows easy height adjustment for height adjustment tube 132B. Bushing 650 and gap filler 656 may be installed at both the upper end and the lower end of the hole through frame top joint 124B to achieve better results.

Returning to FIG. 13, a height memory ring 600 is shown. Height memory ring 600 embraces height adjustment tube 132B, with an opening at one side. The gap size of the opening is adjustable by a screw 602 (with a thumb knob at the invisible side of frame top joint 124B in FIG. 13). Screw 602 may be replaced by a cam lever to achieve the same effect of closing the gap. A user can determine the height of right side upper body support 130B by counting and positioning the holes on tube 124B. However, it would be inconvenient if she or he has to adjust height every time when wheeled walker 100 is opened. In the case, height memory ring 600 brings convenience to users. When a user determines that a preferred height is selected, she or he most likely wants to keep this height. To do this, the user moves height memory ring 600 up to stop against the lower end of joint 124B, then turns screw 602 to close the gap at the opening and lock height memory ring 600 in place. Now the height is memorized and recoupable. After that when wheeled walker 100 is opened and right side upper body support 130B is raised, the user will raise it until she or he feels that height memory ring 600 hits the lower end of joint 124B. And the height is set automatically. Since a user's height changes little, she or he only needs to set up the height for upper body support 128 one time after the walker is purchased. When the height is locked by height memory ring 600, restoring the height when walker is opened becomes convenient and easy.

Figure 15:
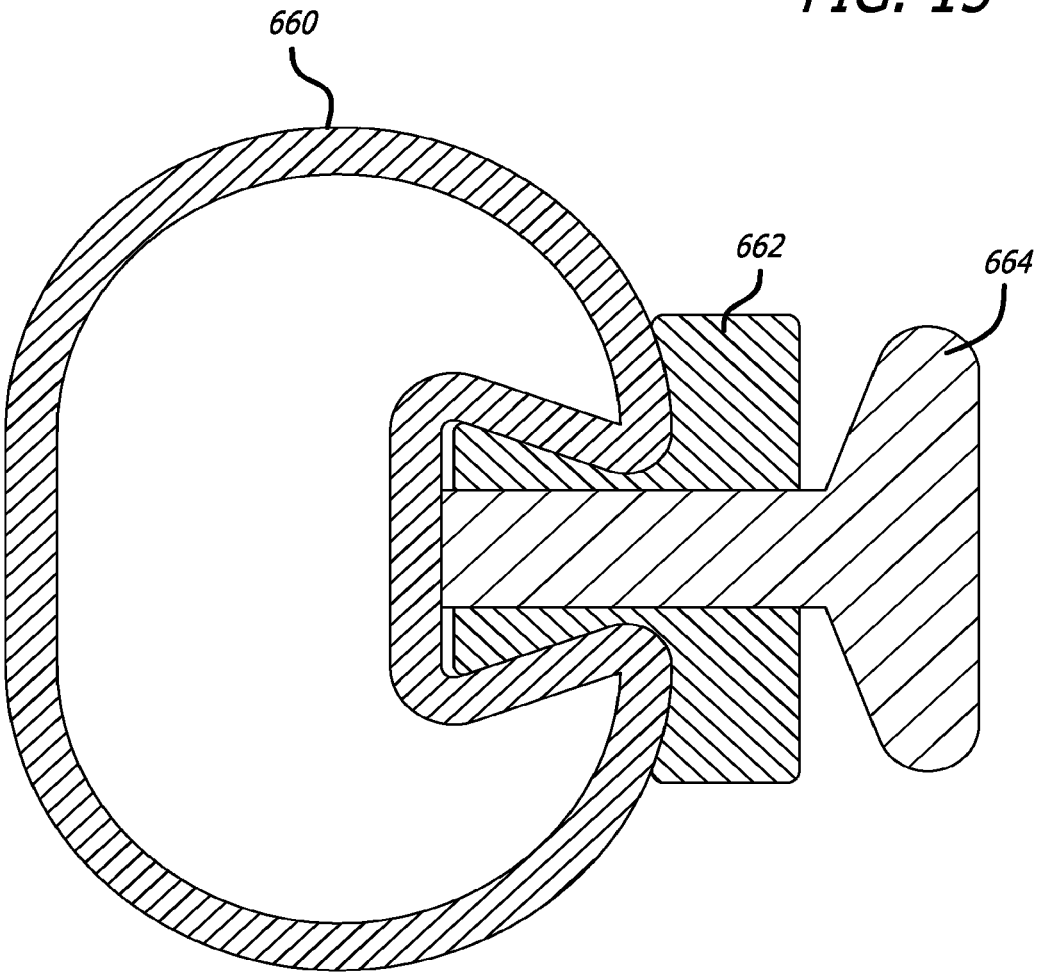
FIG. 15 is a cross-sectional view of a height adjustment block slidably riding in a channel on a height adjustment tube in a wheeled walker.

FIG. 15 shows an alternative height memory device according to the subject matter of this disclosure. Instead of a ring, a height memory block 662 that is attached on one side of height adjustment tube 660 is shown. Height memory block 662 slides in a dovetail channel formed on one side of tube 660. The dovetail channel has an inner space larger than the slot opening so that height memory block 662, which has a matching cross-sectional shape, will not be able to escape. The channel may take another cross-sectional shape, for example, a T-channel, as long as the inner space is larger than the open slot. A screw 664 is threaded through height memory block 662 to reach the inner surface of the dovetail channel of height adjustment tube 660. Height memory device of FIG. 15 may be used on wheeled walker 100 in place of the height memory ring 600 shown in FIG. 13. When the height of upper body support 130B is determined, memory block 662 is moved up against the lower end of frame top joint 124B, and screw 664 is turned to press tightly onto the inner channel surface to lock height memory block 662 in place. Thus, the height is set and recoupable.

As previously noted, various attributes of the wheeled walker (e.g., rollator) 100 may be directed toward enhancing the stability thereof. Along these lines, certain embodiments of the wheeled walker 100 may include forearm gutters 138A-B specifically sized, structured, and positioned to enhance the stability of the wheeled walker 100. To illustrate the stability enhancing features of the forearm gutters 138A-B, reference is made to FIG. 17, which is a reproduction of the top view depicted in FIG. 3, albeit with different reference numbers directed toward specific features of the forearm gutters 138A-B. More specifically FIG. 17 highlights features of the forearm gutters 138A-B relative to two opposing side planes 139A-B, which are positioned such that the left side frame 112A and the right side frame 112B of the wheeled walker 100 extend along respective ones of the pair of side planes 139A-B. It is contemplated that the two opposing side planes 139A-B may be parallel to each other, and may pass through respective ones of the left side frame 112A and the right side frame 112B, although the position of the side planes 139A-B is not limited thereto.

Figure 17:
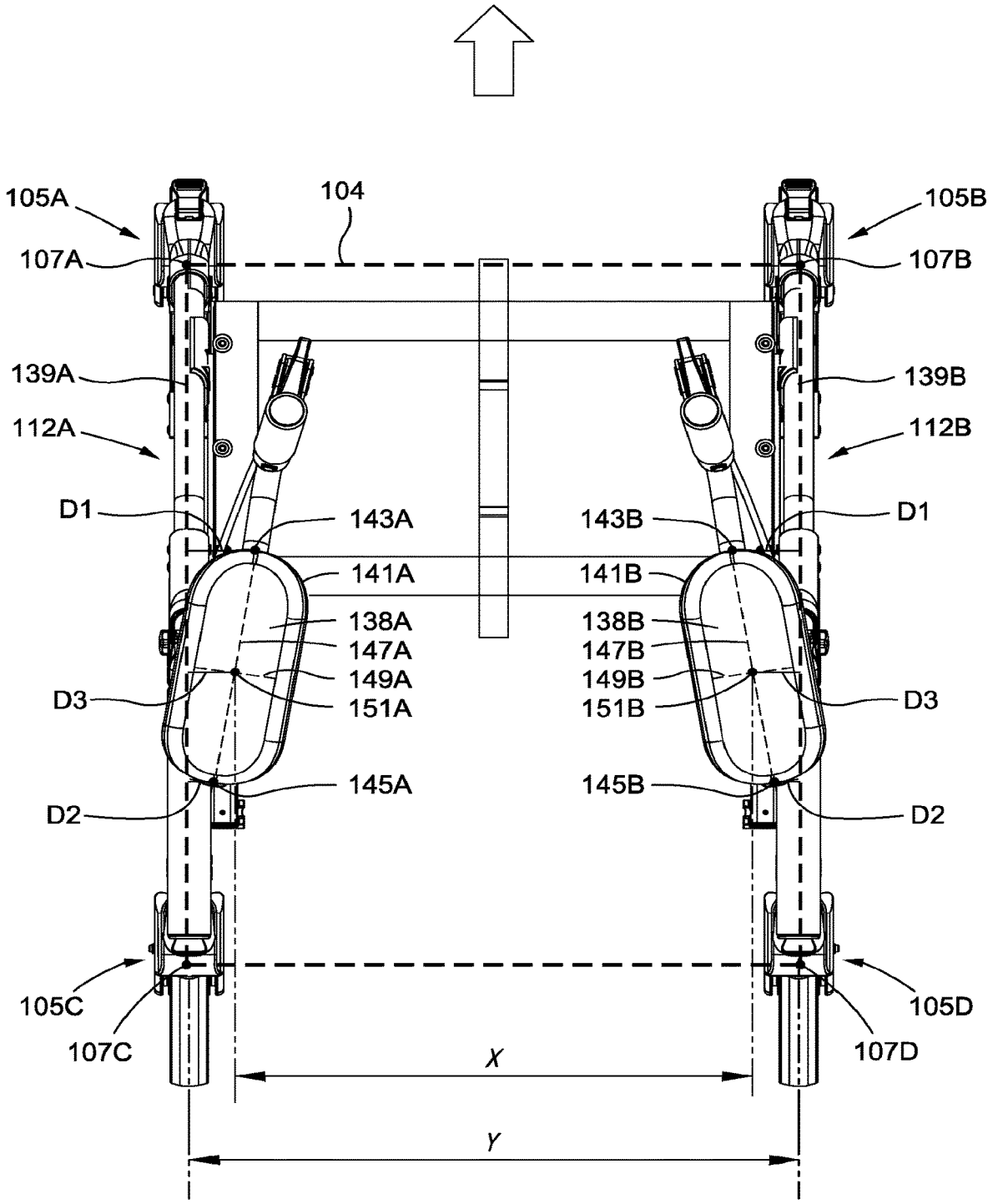
FIG. 17 is a top view of the wheeled walker of FIG. 1.

According to one aspect of this disclosure, each side plane 139A-B may pass through a contact point of a front wheel with an underlying surface and a contact point of a rear wheel with the underlying surface. As shown in FIG. 17, side plane 139A passes through contact point 107A associated with wheel assembly 105A, and contact point 107C associated with wheel assembly 105C. Side plane 139B passes through contact point 107B associated with wheel assembly 105B, and contact point 107D associated with wheel assembly 105D. The side planes 139A-B may be generally perpendicular to the polygonal footprint 104, which may be defined by contact points 107A-D. Thus, when the wheeled walker 100 is positioned on a generally horizontal surface, the side planes 139A-B may be generally vertical.

Each forearm gutter 138A-B may include a peripheral edge 141A-B, a forward midpoint 143A-B on the peripheral edge 141A-B, and a rearward midpoint 145A-B on the peripheral edge 141A-B. Each forearm gutter 138A-B may define a longitudinal axis 147A-B bisecting the respective forearm gutter 138A-B and passing through the forward midpoint 143A-B and the rearward midpoint 145A-B. The forward midpoint 143A-B and the rearward midpoint 145A-B on each forearm gutter 138A-B may reside between the two opposing side planes 139A-B. As shown in FIG. 17, the forward midpoint 143A-B and the rearward midpoint 145A-B on each forearm gutter 138A-B may be spaced from the two opposing side planes 139A-B. The forward midpoint 143A-B may be spaced from the respective side plane 139A-B by a distance D1, while the rearward midpoint 145A-B may be spaced from the respective side plane 139A-B by a distance D2 less than D1.

Each forearm gutter 138A-B may also define a transverse axis 149A-B perpendicular to the longitudinal axis 147A-B of the respective forearm gutter 138A-B and bisecting the respective forearm gutter 138A-B. Each forearm gutter 138A-B may have a midpoint 151A-B at the intersection of the transverse axis 149A-B and the longitudinal axis 147A-B. The midpoints 151A-B may be spaced from each other by a distance X, which may be less than a distance Y separating the opposing planes 139A-B. Furthermore, the midpoints 151A-B may be spaced from the respective side planes 139A-B by a distance D3, which is greater than the distance D2, but less than the distance D1.

Each forearm gutter 138A-B may be sized and configured such that a majority of the longitudinal axis 147A-B extending along the corresponding forearm gutter 138A-B resides between the two opposing side planes 139A-B. In one embodiment, the entirety of the longitudinal axis 147A-B extending along the corresponding forearm gutter 138A-B from the forward midpoint 143A-B to the rearward midpoint 145A-B may reside between the two opposing side planes 139A-B. In this regard, a majority of each forearm gutter 138A-B may be positioned between the two opposing side planes 139A-B.

Clearly, other embodiments and modifications of the subject matter of this disclosure may occur readily to those of ordinary skill in the art in view of these teachings. Therefore, this disclosure includes all such embodiments and modifications when viewed in conjunction with the above specification and accompanying drawings.

What is claimed is:

1. A rollator for use on a walking surface the rollator comprising:

a frame having a first side frame and a second side frame;

a first holder connected to the first side frame;

a second holder connected to the second side frame;

a first support element pivotally coupled to the first side frame and detachably coupled to the second holder;

a second support element pivotally coupled to the second side frame and detachably coupled to the first holder;

a plurality of wheel assemblies coupled to the frame for supporting the frame above the walking surface;

a first upper body support coupled to and disposable at an adjustable height above the first side frame;

a second upper body support coupled to and disposable at an adjustable height above the second side frame; and a pair of forearm gutters coupled to respective ones of the first and second upper body supports.

2. The rollator of claim 1, wherein each of the first holder and the second holder include a concave surface configured to engage with the second support element and first support element, respectively.

3. The rollator of claim 1, wherein each of the first side frame and the second side frame each include at least one curved tube.

4. The rollator of claim 3, wherein the at least one curved tube on each of the first side frame and the second side frame includes a curved front tube and a curved rear tube.

5. The rollator of claim 1, wherein the first side frame and the second side frame extend along respective ones of a spaced, generally parallel pair of planes, each forearm gutter including a peripheral edge, a forward midpoint on the peripheral edge, and a rearward midpoint on the peripheral edge, and defining a longitudinal axis bisecting the respective forearm gutter and passing through the forward midpoint and the rearward midpoint, the forward midpoint and the rearward midpoint on each forearm gutter residing between each of the pair of planes.

6. The rollator of claim 5, wherein the forward midpoint and the rearward midpoint on each forearm gutter are spaced from each of the pair of planes.

7. The rollator of claim 5, wherein each of the pair of planes pass through a respective pair of the plurality of wheel assemblies.

8. The rollator of claim 5, wherein each forearm gutter defines a transverse axis perpendicular to the longitudinal axis of the respective forearm gutter and bisecting the respective forearm gutter, each forearm gutter having a centerpoint at the intersection of the transverse axis and the longitudinal axis, a first distance being defined between the centerpoints of the pair of forearm gutters, and a second distance being defined between the two opposing side planes, the first distance being less than the second distance.

9. The rollator of claim 1, further comprising a seat member translatably coupled to the frame.

10. A rollator for use on a walking surface, the rollator comprising:

a frame having a first side frame and a second side frame;

a first rail holder coupled to the first side frame and a second rail holder coupled to the second side frame;

an X-folder apparatus having an anterior element rotatably coupled to the first side frame and a posterior element rotatably coupled to the second side frame;

a first seat rail coupled to the anterior element and detachably engageable with the second rail holder;

a second seat rail coupled to the posterior element and detachably engageable with the first rail holder;

a plurality of wheel assemblies coupled to the frame for supporting the frame above the walking surface;

a first upper body support coupled to and disposable at an adjustable height above the first side frame;

a second upper body support coupled to and disposable at an adjustable height above the second side frame; and a pair of forearm gutters coupled to respective ones of the first and second upper body supports.

11. The rollator of claim 10, wherein each of the first rail holder and the second rail holder include a concave surface.

12. The rollator of claim 10, wherein each of the first side frame and the second side frame each include at least one curved tube.

13. The rollator of claim 12, wherein the at least one curved tube on each of the first side frame and the second side frame includes a curved front tube and a curved rear tube.

14. The rollator of claim 10, wherein the anterior element includes two ends and the posterior element includes two ends, the anterior element rotatably coupled to the posterior element, rotation of the anterior element and the posterior element is adapted to move the X-folder between an open X-folder state and a closed X-folder state.

15. The rollator of claim 14 wherein the first end of the anterior element is rotatably coupled to a lower portion of the first side frame at two locations disposed at a first horizontal distance, and the first end of the posterior element of the X-folder is rotatably coupled to a lower portion of the second side frame at two locations disposed at a second horizontal distance, such that the first horizontal distance and the second horizontal distance are selected to dispose the first side frame into substantial parallel disposition with the second side frame.

16. The rollator of claim 10, further comprising a seat member translatably coupled to the frame.

17. A rollator for use on a walking surface the rollator comprising:

a frame having a first side frame and a second side frame;

a first holder connected to the first side frame;

a second holder connected to the second side frame;

an X-folder apparatus having a pair of pivotally connected rigid elements, each rigid element being pivotally coupled to a respective one of the first side frame and the second side frame and being detachably engageable to respective ones of the first holder and the second holder;

a plurality of wheel assemblies coupled to the frame for supporting the frame above the walking surface; and a pair of forearm gutters adjustably coupled to respective ones of the first and second side frames.

18. The rollator of claim 17, wherein each of the first holder and the second holder include a concave surface.

19. The rollator of claim 17, wherein each of the first side frame and the second side frame each include at least one curved tube.

20. The rollator of claim 19, wherein the at least one curved tube on each of the first side frame and the second side frame includes a curved front tube and a curved rear tube.

* * * * *